US005985535A

United States Patent [19]

Urabe

[11] Patent Number: 5,985,535

[45] Date of Patent: Nov. 16, 1999

[54] METHOD FOR PRODUCING SILVER HALIDE EMULSION AND SILVER HALIDE PHOTOGRAPHIC EMULSION

[75] Inventor: Shigeharu Urabe, Kanagawa, Japan

[73] Assignee: Fuji Photo Film Co., Ltd., Kanagawa, Japan

[21] Appl. No.: 08/997,691

[22] Filed: Dec. 23, 1997

[30] Foreign Application Priority Data

Dec. 26, 1996 [JP] Japan ..... 8-348528
Jun. 4, 1997 [JP] Japan ..... 9-146874

[51] Int. Cl.[6] ..... G03C 1/015; B01F 13/08

[52] U.S. Cl. ..... 430/569; 366/273; 366/274

[58] Field of Search ..... 366/273, 274; 430/569

[56] References Cited

U.S. PATENT DOCUMENTS

| | | | |
|---|---|---|---|
| 2,912,343 | 11/1959 | Colins et al. | 430/550 |
| 3,801,326 | 4/1974 | Claes | 430/569 |
| 5,051,350 | 9/1991 | Terai et al. | 430/569 |
| 5,213,772 | 5/1993 | Ichikawa et al. | 422/245 |
| 5,217,858 | 6/1993 | Maskasky | 430/567 |
| 5,389,509 | 2/1995 | Maskasky | 430/567 |
| 5,411,851 | 5/1995 | Maskasky | 430/569 |
| 5,411,853 | 5/1995 | Maskasky | 430/569 |
| 5,418,125 | 5/1995 | Maskasky | 430/569 |
| 5,460,934 | 10/1995 | Delton | 430/567 |
| 5,470,698 | 11/1995 | Wen | 430/567 |

OTHER PUBLICATIONS

Aldrich Handbook of Fine Chemicals, 1998–1999, pp. T557–T563.

*Primary Examiner*—Mark F. Huff
*Attorney, Agent, or Firm*—Sughrue, Mion, Zinn, Macpeak & Seas, PLLC

[57] ABSTRACT

A method for producing a silver halide emulsion is disclosed, which comprises:

supplying a water-soluble silver salt aqueous solution and a water-soluble halide aqueous solution from solution-feeling ports provided in a closed type stirring tank of a mixing vessel, controlling the stirring condition of the mixture of aqueous solutions supplied by rotation-driving at least one pair of stirring blades having no rotary shaft protruding the wall of the stirring tank, which are disposed in said stirring tank;

discharging silver halide fine grains which are formed with the completion of the stirring process from a solution-discharging port provided in a closed type stirring tank; and supplying said silver halide fine grains to a reaction vessel where nucleation and/or grain growth of silver halide grains are conducted, and further a silver halide photographic emulsion comprising a dispersion medium and silver halide grains produced by the above method is disclosed.

2 Claims, 4 Drawing Sheets

METHOD FOR PRODUCING SILVER HALIDE EMULSION AND SILVER HALIDE PHOTOGRAPHIC EMULSION

FIELD OF THE INVENTION

The present invention relates to a method for producing silver halide emulsion and, more particularly, to a method for producing homogeneous and thin tabular grains.

BACKGROUND OF THE INVENTION

A method for producing silver halide grains comprises two main processes of nucleation and grain growth. There are disclosed in T. H. James, *The Theory of the Photographic Process*, 4th Ed., Macmillan (1977) that "Nucleation is a process in which new crystals are formed, wherein rapid increase of the number of crystals occurs. Growth means the addition of new layers to already existing crystals. In addition to the above nucleation and grain growth, further two more processes of Ostwald ripening and recrystallization occur under the certain conditions of the grain formation of photographic emulsion grains. Ostwald ripening is liable to come about when a grain size distribution is wide under comparatively high temperature and in the presence of a silver halide solvent. Recrystallization is the process of changing of crystal structure." That is, a grain nucleus is formed at early stage of the silver halide grain formation and the growth of grains is conducted only by already existing nuclei and the number of grains during growing process does not increase.

Silver halide grains are in general produced by the reaction of a silver salt aqueous solution and a halide aqueous solution in a colloid aqueous solution in a reaction vessel. A single jet method in which protective colloid, such as gelatin, and a halide aqueous solution are added into a reaction vessel and, while vigorously stirring the protective colloid and the halide aqueous solution, a silver salt aqueous solution is added thereto over a certain period of time; and a double jet method in which a gelatin aqueous solution is added into a reaction vessel and a silver salt aqueous solution and a halide aqueous solution are added thereto over a certain period of time at the same time are known. When two methods are compared, silver halide grains having a narrow grain size distribution can be obtained and the halide structure can be freely changed with the progress of the grain growth according to a double jet method.

It has been known that the nucleation and the growth of silver halide grains are largely varied according to the silver ion (halide ion) concentration, the concentration of a silver halide solvent, the degree of supersaturation and the temperature of a reaction solution. In particular, nonuniformity of the concentration of silver ion or halide ion produced by a silver salt aqueous solution and a halide aqueous solution added to a reaction vessel causes uneven degrees of supersaturation and solubility in a reaction vessel due to each uneven distribution. As a result, the nucleation speed or grain growing speed becomes uneven in the reaction vessel leading to nonuniformity of silver halide crystals produced.

For lowering this nonuniformity, rapid and uniform mixing and reaction of a silver salt aqueous solution and a halide aqueous solution supplied to a colloid solution are necessary to make uniform concentration of a silver ion or a halide ion in a reaction vessel during silver halide grain formation. Various studies have been so far made as to the realization of the uniform mixing of a silver salt aqueous solution and a halide aqueous solution, for example, contrivances of stirring and mixing apparatuses for solving the above problem are disclosed in U.S. Pat. No. 3,415,650, British Patent 1,323,464, U.S. Pat. No. 3,692,283, JP-B-55-10545 (the term "JP-B" as used herein means an "examined Japanese patent publication"), and JP-A-57-92523 (the term "JP-A" as used herein means an "unexamined published Japanese patent application"). Producing methods and mixing apparatuses disclosed in these patents consist of a structure comprising a casing having an open area and a rotor in the casing which is provided in the reaction vessel, and a silver salt aqueous solution and a halide aqueous solution are added to a mixing vessel and both are rapidly mixed while diluting with a colloid solution in the reaction vessel.

However, although local nonuniform concentrations of a silver ion and a halide ion in the reaction vessel of these apparatuses can be certainly solved, nonuniform concentrations still exist in the mixing vessel, in particular, a considerable uneven concentrations are distributed in the vicinity of a feeding nozzle of a silver salt aqueous solution and a halide aqueous solution and around stirring blades. Silver halide grains supplied to the mixing vessel with protective colloid pass through such nonuniform part and a more important fact is that silver halide grains rapidly grow at these parts. This means grain growth occurs at nonuniform parts of concentration. Therefore, uniform silver halide grain growth cannot be attained.

Producing methods in which a reaction vessel is independent of a mixing vessel for solving the distribution of nonuniform concentrations of a silver ion and a halide ion by more complete mixture are disclosed in JP-A-53-37414, JP-B-48-21045 and U.S. Pat. No. 3,897,935. However, the colloid aqueous solution in the reaction vessel of these apparatuses is also circulated to the mixing vessel and silver halide grains also grow with passing through nonuniform parts.

Producing method for solving these problems are disclosed in JP-B-7-82208, JP-B-7-23218 and U.S. Pat. No. 4,879,208. According to these methods, a mixing vessel is provided at the outside of a reaction vessel where nucleation and/or grain growth of silver halide grains are caused, a silver salt aqueous solution and a halide aqueous solution are supplied to said mixing vessel and mixed therein to form silver halide fine grains, the formed fine grains are immediately supplied to a reaction vessel and nucleation and/or grain growth are conducted within said reaction vessel. This method is characterized in that silver halide formation by the addition of a silver salt aqueous solution and a halide aqueous solution is substantially not conducted in the reaction vessel where nucleation and/or grain growth of silver halide grains are carried out, and further the circulation of the emulsion in the reaction vessel to the mixing vessel is not conducted at all. According to this method, extremely fine grains formed in the mixing vessel are introduced into the reaction vessel and then dispersed in the reaction vessel by stirring. As grain sizes are extremely fine, grains are easily dissolved and silver ions easily release halide ions. As a result, uniform nucleation and/or grain growth can be caused.

A method for producing an extremely thin tabular grain emulsion having an average thickness of less than 0.07 $\mu$m according to Dual Zone Process is disclosed in European Patent Application No. 507701A. This patent discloses a method for producing extremely thin tabular grains by the same methods as disclosed in the above JP-B-7-23218, JP-B-7-82208, U.S. Pat. No. 4,879,208 and European Patent Application No. 326852B. According to this method, tabular grain nuclei are formed by adding a silver nitrate aqueous solution, an NaBr aqueous solution and a gelatin aqueous solution respectively independently to a mixing vessel within a short period of time (from 0.5 minutes to 2 minutes), the silver halide fine grain emulsion formed is transferred as it is to a reaction vessel containing a gelatin aqueous solution, ripened, thus tabular grain nuclei are formed, thereafter silver halide fine grains are further transferred in the same manner from the mixing vessel to the reaction vessel and tabular grain nuclei are grown to obtain extremely thin tabular grain emulsion.

It has become possible to produce thin tabular grains having such the high uniformity but an important point in this method is to form extremely fine grains having a finer grain size well controlled in a mixing vessel.

The mixing vessel shown in FIG. 5 is disclosed in JP-B-7-82208, JP-B-7-23218 and U.S. Pat. No. 4,879,208. In FIG. 5, 7 indicates a mixing apparatus, a reaction vessel 1 is provided therein, and a rotary shaft 11 fitted with stirring blades 9 is provided within the reaction vessel 1. A silver salt aqueous solution, a halide aqueous solution and a protective colloid aqueous solution are supplied from three feeding ports (4 and 5, another is omitted from the figure), mixed rapidly and vigorously by rotating the rotary shaft at high speed (1,000 rpm or more, preferably 2,000 or more, more preferably 3,000 rpm or more), the solution containing extremely fine silver halide grains formed is immediately discharged through a discharging port 8 to the outside and added to a reaction vessel where nucleation and/or grain growth of silver halide grains are conducted.

A concrete example of this mixing machine is shown in FIG. 6. This apparatus is one manufactured by WILLY A PACHOFEN AG MASHINEN FABRIK. This apparatus is constructed of a stirring tank 42 of an almost cylindrical shape and a plurality of stirring blades 43 which are rotation-driven in the stirring tank 42. The stirring tank 42 is an almost closed vessel of the structure provided with a solution-feeding port 44 on one side to introduce an objective solution of stirring and a solution discharging port 45 on the other side to discharge the solution after stirring processing. A plurality of stirring blades 43 are fixed on a sleeve laid on a rotary shaft 46 protruding through the end wall of the other side of the stirring tank 42. These stirring blades rotate in a body with the rotary shaft 46 through the sleeve to accelerate stirring of the solution in the stirring tank 42. The rotary shaft 46 is rotation driven by the motor shown in the figure.

There are problems in the mixing vessel shown in FIG. 5 with respect to the following two points.

1) As shown in FIG. 5, as the rotary shaft 11 protrudes through the mixing apparatus 7, sealing is necessary at the protruding part. In particular, for forming homogeneous and extremely fine grains having finer grain size in the mixing vessel, stirring blades 9 should be rotated at high speed but sealing is liable to become incomplete due to this high speed rotation. Therefore, the high speed rotation mixing could not be realized. As the sealed part is required not only to prevent the leakage of the solution within the tank but also to have lubricating capability, liquid seal is sometimes employed but it is very difficult to maintain liquid seal in an ideal condition and in some cases a problem such that the sealing liquid used for the liquid seal is mixed in the solution in the stirring tank as impurities arises.

2) In FIG. 5, when stirring blades 9 are rotated at high speed (2,000 rpm or more), strong centrifugal force operates within the vessel and the solution in a mixing space 10 is pushed to the wall of the mixing vessel, as a result, a cavity is generated at the central part. Therefore, mixing of the solutions added cannot be conducted efficiently and the improvement of mixing capability by the increase of the rotating speed of stirring blades can not be obtained, and further mixing capability is sometimes reduced.

Further, in the conventional structure shown in FIG. 6, at the part of the end wall of the stirring tank 42 where the rotary shaft 46 protrudes, not only sealing capability to prevent the leakage of the solution which has been stirred and mixed to the outside but also lubricating capability necessary for smooth and high speed rotation of the rotary shaft 46 are required. For satisfying these both requirements, in general, liquid seal is employed as a sealing means but it is very difficult to maintain liquid seal in an ideal condition and in some cases the lubricating liquid (sealing liquid) used for liquid seal is mixed in the stirring tank 42 as impurities and impairs emulsifying capability. Further, when the solution mixed with the lubricating liquid is stirred, the removal of the lubricating liquid from the solution is very difficult.

Moreover, as the rotation of respective stirring blades 43 is in the same direction, the flow of the solution in the tank is liable to be regularized, and when the rotating speed of the rotary shaft 46 is increased for improving stirring efficiency, a cavity is generated around the sleeve 47, which is the center of the stirring tank 42, and the solution to be stirred and mixed flows in the tank along the inner peripheral surface of the stirring tank 42 then exhausted, as a result, a silver salt aqueous solution and a halide aqueous solution added are discharged without being mixed sufficiently.

SUMMARY OF THE INVENTION

The object of the present invention is to solve the above problems, specifically, the object of the present invention is to easily improve a mixing efficiency by high speed rotation of stirring blades to thereby increase an emulsion production efficiency and, further, to realize formation of thin and homogeneous tabular silver halide grains in a reaction vessel by formation of extremely fine grains having a uniform size in a mixing vessel.

As a result of extensive investigations, the object of the present invention has been achieved by (1) below.

(1) A method for producing a silver halide emulsion which comprises:

supplying a water-soluble silver salt aqueous solution and a water-soluble halide aqueous solution from solution-feeding ports provided in a closed type stirring tank of a mixing vessel;

controlling the stirring condition of the mixture of aqueous solutions supplied by rotation-driving at least one pair of stirring blades (i.e., at least one of a pair having two strirring blades) having no rotary shaft protruding the wall of the stirring tank, which are disposed in said stirring tank;

discharging silver halide fine grains which are formed with the completion of the stirring process from a solution-discharging port provided in a closed type stirring tank; and supplying said silver halide fine grains to a reaction vessel where nucleation and/or grain growth of silver halide grains are conducted.

(2) A method for producing a silver halide emulsion which comprises:

supplying a water-soluble silver salt aqueous solution and a water-soluble halide aqueous solution from solution-feeding ports provided in a closed type stirring tank of a mixing vessel;

disposing at least two pairs of stirring blades having no rotary shaft protruding the wall of the stirring tank at opposed positions in the tank with a distance between, rotation-driving these stirring blades in converse directions, and controlling the stirring condition of the mixture of aqueous solutions supplied;

discharging silver halide fine grains which are formed with the completion of the stirring process from a solution-discharging port provided in a closed type stirring tank; and supplying said silver halide fine grains to a reaction vessel where nucleation and/or grain growth of silver halide grains are conducted.

More preferred embodiments of the present invention are shown in the following items (3) to (10).

(3) A method for producing a silver halide emulsion described in the above item (1) or (2), wherein each of said stirring blades has a magnetic coupling relationship with the outer magnet disposed outside the tank wall adjacent to each stirring blade and each stirring blade having no rotary shaft protruding the tank wall is rotation-driven by the motor connected to said outer magnet.

(4) A method for producing a silver halide emulsion described in the above item (1) or (2), wherein a double side bipolar magnet comprising an N pole face and an S pole face disposed so as to be parallel to a central axis of rotation and superposed interposing said central axis of rotation is used in one of said stirring blades and said outer magnet coupled by magnetic coupling, and a bilateral bipolar magnet comprising an N pole face and an S pole face standing abreast at symmetrical positions to said central axis of rotation on the plane orthogonal to said central axis of rotation is used in another.

(5) The silver halide photographic emulsion comprising a dispersion medium and silver halide grains, produced according to the method described in the above item (1) or (2), wherein at least 50% of the entire projected area of said silver halide grains are occupied by tabular silver halide grains having an average aspect ratio of 5/1 or more and opposed major planes parallel to each other of said tabular silver halide grains have {111} faces.

(6) The silver halide photographic emulsion comprising a dispersion medium and silver halide grains, produced according to the method described in the above item (1) or (2), wherein at least 50% of the entire projected area of said silver halide grains are occupied by tabular silver halide grains having an average aspect ratio of 5/1 or more and having {111} faces as opposed major planes parallel to each other, and the average thickness of said tabular silver halide grains is less than 0.1 $\mu$m.

(7) The silver halide photographic emulsion comprising a dispersion medium and silver halide grains produced according to the method described in the above item (1) or (2), wherein at least 50% of the entire projected area of said silver halide grains are occupied by tabular silver halide grains having an average aspect ratio of 5/1 or more and having {111} faces as opposed major planes parallel to each other, and the average thickness of said tabular silver halide grains is less than 0.07 $\mu$m.

(8) The silver halide photographic emulsion comprising a dispersion medium and silver halide grains described in any one of the above item (5), (6) or (7), wherein said silver halide grains are produced by conducting nucleation and/or grain growth in the presence of trimellited gelatin.

(9) The silver halide photographic emulsion comprising a dispersion medium and silver halide grains described in any one of the above item (5), (6) or (7), wherein said silver halide grains are produced by conducting nucleation and/or grain growth in the presence of succinated gelatin.

(10) The silver halide photographic emulsion comprising a dispersion medium and silver halide grains described in any one of the above item (5), (6) or (7), wherein said silver halide grains are produced by conducting nucleation and/or grain growth in the presence of maleated gelatin.

KEY TO THE SYMBOLS

Figure 1:
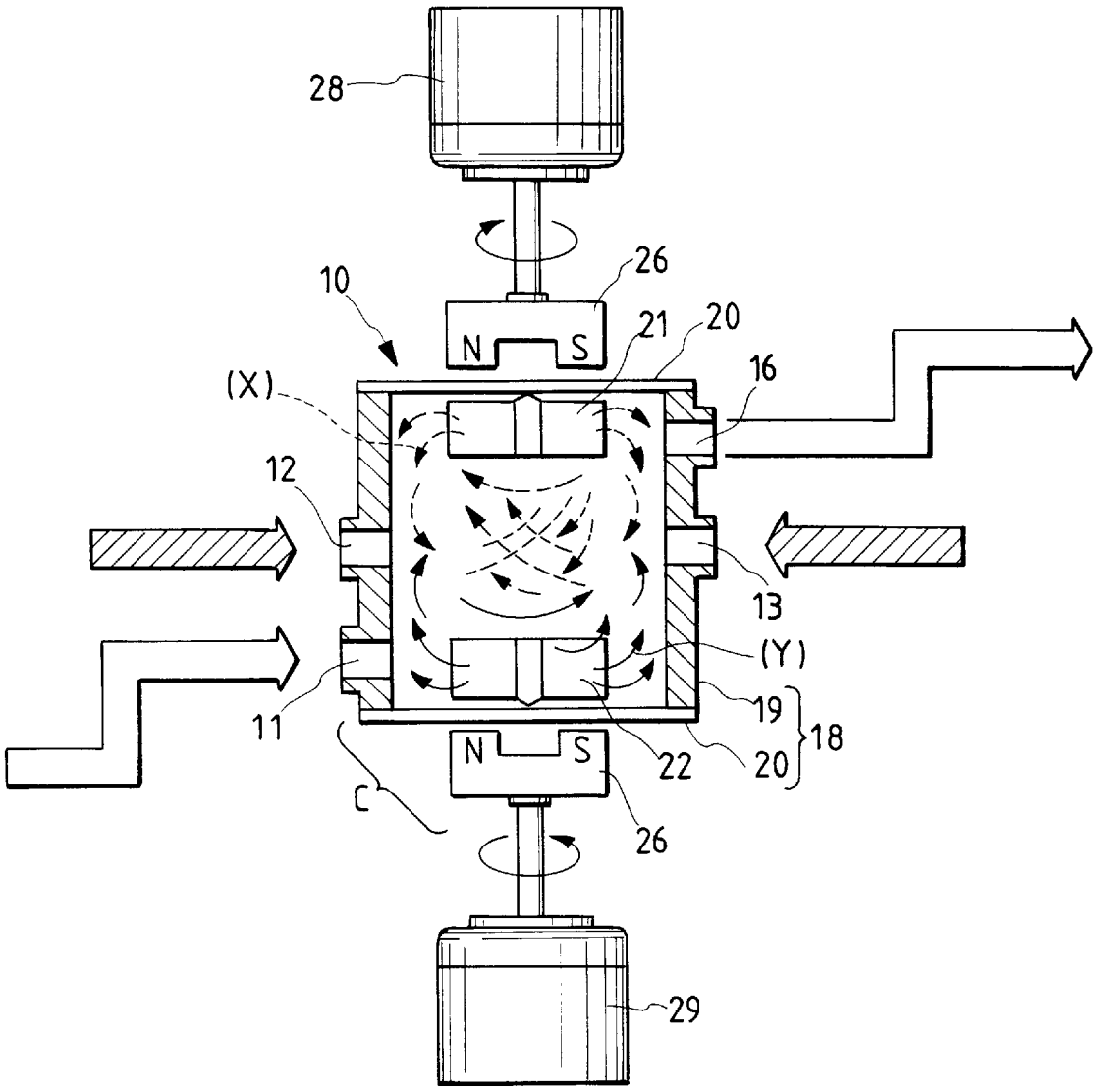
FIG. 1 is a cross sectional view showing the schematic construction of the mixing apparatus having two pairs of stirring bleades according to the present invention.

1: Reaction vessel
2: Protective colloid aqueous solution
3: Stirring blades
10: Mixing apparatus
11, 12, 13: Solution-feeding port
16: Solution-discharging port
18: Stirring tank (i.e., Mixing vessel)
19: Stirring tank body
20: Seal plate
21, 22: Stirring blades (i.e., Pair of stirring bleades)
26: Outer magnet
28, 29: Motor
31: Central axis of rotation
33: Double side bipolar magnet
35: Bilateral bipolar magnet L: Magnetic line of force
42: Stirring tank (i.e., Mixing vessel)
43: Stirring blades
44: Solution-feeding port
45: Solution-discharging port
46: Rotary shaft
47: Sleeve Now, the average thickness of tabular silver halide grains is generally less than 0.1 $\mu$m as described above, preferably from 0.01 $\mu$m to less than 0.1 $\mu$m, and particularly preferably from 0.03 $\mu$m to less than 0.07 $\mu$m. Further, the average aspect ratio is generally 5/1 or more as described above, preferably from 5/1 to less than 100/1, and more preferably from 10/1 to less than 70/1.

The above-described two problems can be completely solved by the constitution of the present invention. That is, by the apparatus shown in FIG. 1 below.

With respect to problem 1), the present invention completely solved this problem by adopting the structure of stirring blades having no rotary shaft protruding the stirring tank; and with respect to problem 2), the present invention completely solved this problem by rotating opposite two pairs of stirring blades in converse directions to thereby prevent generation of a vacancy at the central part of the stirring tank by preventing generation of the flow in the shaft direction.

Thus, it has become possible for the first time by the present invention to completely realize the effect of the producing methods disclosed in JP-B-7-23218, JP-B-7-82208, U.S. Pat. No. 4,879,208 and European Patent Application No. 326852B.

DETAILED DESCRIPTION OF THE INVENTION

The present invention is described in detail below.

Figure 2:
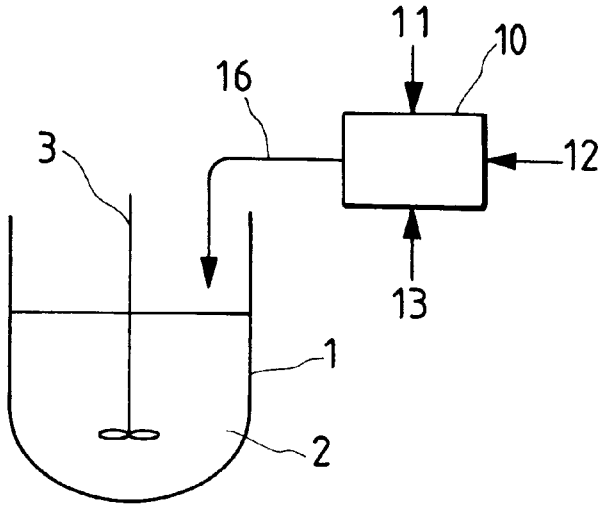
FIG. 2 is a schematic cross sectional view showing the process for producing the silver halide emulsion according to the present invention.

The mode of conducting nucleation and/or grain growth according to the present invention is shown in FIG. 2. In FIG. 2, a reaction vessel 1 includes a protective colloid aqueous solution 2. The protective colloid aqueous solution is stirred by stirring blades 3 attached to a rotary shaft (a propeller type is shown in this figure). A silver salt aqueous solution, a halide aqueous solution and, if necessary, a protective colloid aqueous solution are respectively introduced to a mixing apparatus 10 (described later in FIG. 1) installed outside of the reaction vessel through an addition system (solution-feeding ports 11, 12 and 13). (In this case, if necessary, the protective colloid aqueous solution may be added in admixture with the silver salt aqueous solution and/or the halide aqueous solution.) These solutions are rapidly and vigorously mixed in the mixing vessel (i.e., stirring tank) of the mixing apparatus, immediately introduced to the reaction vessel 1 through a solution-discharging port 16 and nucleation is conducted in the reaction vessel. At this time, the emulsion discharged from the mixing vessel (i.e., stirring tank) can be reserved in other vessel and added later to the reaction vessel.

After nucleation is finished in the reaction vessel, a silver salt aqueous solution, a halide aqueous solution and, if necessary, a protective colloid aqueous solution are further respectively introduced to the mixing apparatus 10 through solution-feeding ports 11, 12 and 13. (In this case, if necessary, the protective colloid aqueous solution may be added in admixture with the silver salt aqueous solution and/or the halide aqueous solution.) These solutions are rapidly and vigorously mixed in the mixing vessel (i.e., stirring tank) of the mixing apparatus, immediately and continuously introduced to the reaction vessel 1 through the solution-discharging port 16 and the growth of nuclei already formed in the reaction vessel is conducted in the reaction vessel.

The executing mode of the mixing apparatus (stirring apparatus) according to one embodiment of the present invention shown in FIG. 1 is described below.

As described above, when stirring blades are attached with a driving shaft and rotated at high speed by a driving apparatus as conventionally conducted, sealing of the mixing vessel and the driving shaft is-very difficult. In the present invention, this problem has been solved by adopting the structure having no driving shaft and the rotation conducted by magnetic induction due to stirring blades and the outer magnet connected with magnetic coupling as shown below. In FIG. 1, a stirring tank 18 consists of a stirring tank body 19 having a central axis of rotation facing in top and bottom directions and seal plates 20 which function as tank walls sealing top and bottom opening ends of the tank body 19. The tank body 19 and the seal plate 20are made of nonmagnetic materials which are excellent in magnetic permeability. Stirring blades 21 and 22 are disposed at the top and bottom ends of the stirring tank 18 which are opposite each other with a distance between and rotation driven in converse directions. Stirring blades 21 and 22 each constitutes magnetic coupling C with an outer magnet 26 disposed outside the tank wall abjacent to each stirring blade 21 and 22 (seal plate 20). That is, each stirring blade 21 and 22 is linked to each outer magnet 26 by magnetic force and the rotation is operated in converse directions by rotation-driving each outer magnet by independent motors 28 and 29, respectively.

Further, in FIG. 1, the mixing apparatus consists of a stirring tank 18 provided with solution-feeding ports 11, 12 and 13 for supplying a silver salt aqueous solution, a halide aqueous solution and, if necessary, a colloid aqueous solution to be stirred and a solution-discharging port 16 for discharging the silver halide fine grain emulsion after stirring processing, and a pair of stirring blades 21 and 22 which are the stirring means for controlling the stirring condition of the solution in the stirring tank 18 by rotation-driving. As the shape of the mixing vessel (i.e., stirring tank) 18, a cylindrical shape is often used but rectangular, hexagonal and various other shapes may be used. Further, a pair of stirring blades are disposed at the top and bottom ends of the stirring tank 18 which are opposite each other with a distance between and rotation-driven in converse directions. This one pair of stirring blades are disposed at the opposite top and bottom ends of the stirring tank in FIG. 1 but they may be disposed at the opposite left and right sides, or may be disposed diagonally. In FIG. 1, a pair of stirring blades are disposed at the opposite positions but two or more pairs of an even number of four or more conversely rotating stirring blades may be used, otherwise an odd number which does not form a pair (including one) of stirring blades may also be used. Moreover, by the combined use of an even number of conversely rotating stirring blades making a pair and an odd number (including one) of stirring blades, more efficient stirring can be practiced.

In the present invention, when opposite stirring blades are driven in the stirring vessel (i.e., stirring tank), it is necessary to rotate stirring blades at high speed for obtaining a higher mixing efficiency. The rotation speed is 1,000 rpm or more, preferably 3,000 or more, and more preferably 5,000 rpm or more. A pair of conversely rotating stirring blades is rotated at the same rotating speed in some case and at different rotating speeds in another case.

Figure 3:
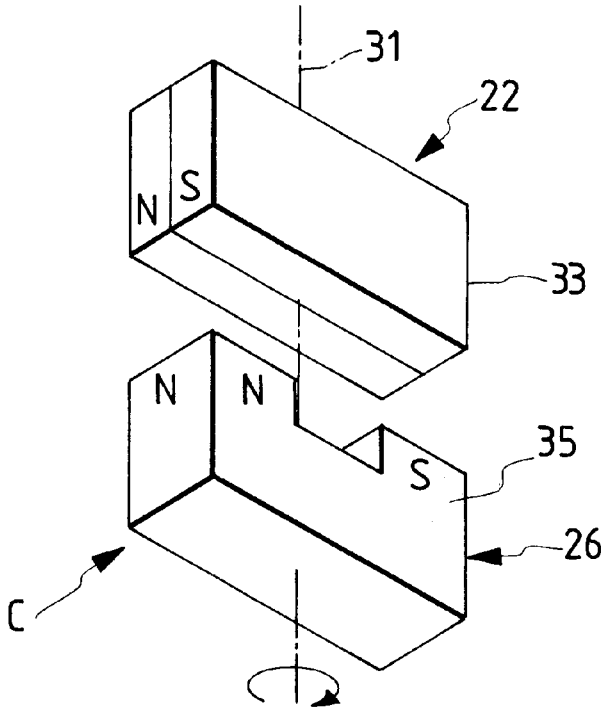
FIG. 3 is a perspective view showing the magnetic coupling used in the mixing apparatus according to the present invention.

The structure of the magnetic coupling C at the bottom end of the stirring tank 18 is shown in FIG. 3. In this magnetic coupling C in one executing mode, a double side bipolar magnet 33 of the structure with disposing an N pole face and an S pole face so as to be parallel to the central axis of rotation 31 and superposed interposing the central axis of rotation 31 is used as stirring blades 21 and 22 comprising magnetic coupling C as shown in the figure. A bilateral bipolar magnet 35 (a U-type magnet) of the structure of an N pole face and an S pole face standing abreast at symmetrical positions to the central axis of rotation 31 on the plane orthogonal to the central axis of rotation 31 is used as the outer magnet 26. In this magnetic coupling C, in contrast with the above case, even if a double side bipolar magnet 33 is used as the outer magnet 26 and a bilateral bipolar magnet 35 as stirring blades 21 and 22, the same mixing efficiency can be obtained.

Figure 4A:
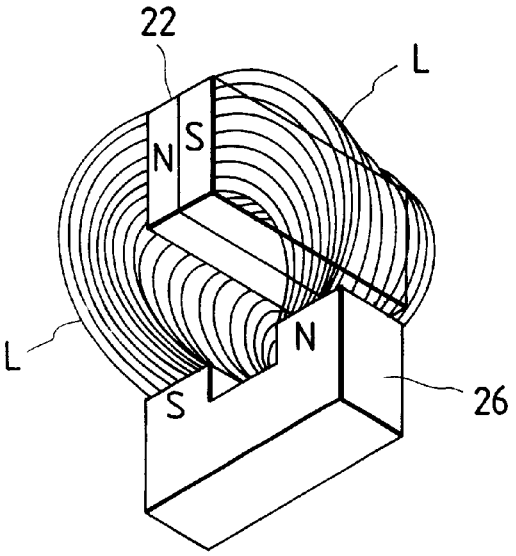
FIG. 4(*a*) and 4(*b*) are is a perspective views showing the action of the magnetic coupling shown in FIG. 3.
Figure 4B:
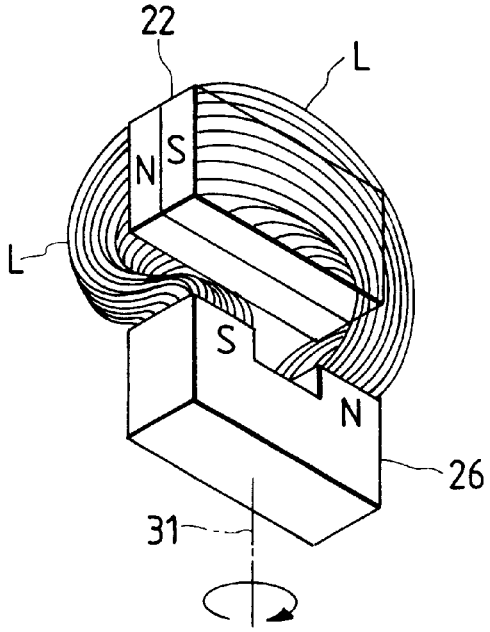

In the above magnetic coupling C, the magnetic line of force L connecting the outer magnet 26 with stirring blades 21 and 22 is as shown in FIG. 4(*a*) and, for example, when compared with the magnetic flux formed in the case of constituting magnetic coupling by bilateral bipolar magnets by themselves, the magnetic flux diameter connecting magnets each other can be doubled and, at the same time, when the outer magnet 26 is rotation-operated, magnetic flux deflects as shown in FIG. 4 (*b*) and it is possible to invest the magnetic coupling with flux viscosity which prevents the cutting of magnetic flux. Therefore, the connection strength as coupling is improved largely and high speed rotation of stirring blades 21 and 22 becomes possible by the use of a high rotary motor as motors 28 and 29.

In the mixing apparatus 10 shown in FIG. 1, a pair of stirring blades 21 and 22 disposed at opposed positions in the stirring tank 18 generate stirring flows respectively in different directions as shown by a broken line arrow (X) and a solid line arrow (Y) in the figure. As the flowing directions of the stirring flows generated by stirring blades 21 and 22 are different, they impinge to each other and cause a high speed turbulent flow in the stirring tank 18 which accelerates the stirring in the stirring tank 18 and prevents the regularization of the flow, and when the rotation of stirring blades 21 and 22 is speeded up, not only the formation of a vacancy around the rotation axis of stirring blades 21 and 22 can be prevented but also the occurrence of inconvenience such as the formation of regularized flow not subjected to sufficient stirring and flowing in the tank 18 along the inner peripheral surface of the stirring tank 18 can be inhibited.

Further, as stirring blades 21 and 22 in the stirring tank 18 are linked with motors 28 and 29 disposed outside the stirring tank 18 by magnetic coupling, there is no necessity for a rotary shaft protruding the wall of tank 18, as a result, the stirring tank 18 can be made with the structure of a closed container, not only the solution stirred and mixed can be prevented from leaking out to the outside but also a lubricating liquid (a sealing liquid) for a rotary shaft can be prevented from mixing in the solution as impurities deteriorating the quality of a silver halide emulsion.

Furthermore, the structure of the magnetic coupling C shown in FIG. 3 comprises the combination of a double side bipolar magnet 33 and a bilateral bipolar magnet 35, and as the linking strength as coupling is greatly improved by this structure as compared with the case where bilateral bipolar magnets 35 are disposed at opposite sides each to each, it becomes possible for stirring blades 21 and 22 to be rotation driven at higher speed.

The production method of the present invention is characterized in that extremely fine silver halide grains formed in a mixing vessel having high stirring capability are introduced into a reaction vessel and dispersed in the reaction vessel by stirring, and as each grain size is extremely fine, grains are easily dissolved and regenerate as silver ions and halide ions, and cause homogeneous nucleation or grain growth in the reaction vessel. Grains formed in the mixing vessel are extremely fine and numerous. Since silver ions and halide ions are released from such numerous grains (in the case of silver halide mixed crystals, the halide compositions have got the objective ones), uniform nucleation and grain growth can be caused over the entire protective colloid in the reaction vessel. According to the present invention, completely uniform silver halide mixed crystals can be prepared and, further, the complete uniformity thereof can be confirmed easily by a cooled transmission type electron microscope.

The residence time of the solution introduced to the mixing vessel of the present invention is represented by the following equation:

$$t=v/(a+b+c)$$

v: The volume of the mixing space of a mixing vessel a: The addition amount of a silver salt solution b: The addition amount of a halide solution c: The addition amount of a protective colloid solution In the present invention, t is 20 sec. or less, preferably 10 sec. or less, more preferably 5 sec. or less, and most preferably 2 sec. or less. When the residence time is long, extremely fine grains once formed in the mixing vessel grow to larger sizes and the size distribution becomes wide, which is not preferred.

In the present invention, a protective colloid aqueous solution is added to a mixing vessel by the following methods.

a. A protective colloid solution is added to a mixing vessel alone. The concentration of protective colloid is 0.5% or more, preferably from 1% to 20%. The flow rate thereof is at least from 20% to 300%, preferably from 50% to 200%, per the sum of flow rate of a silver salt solution and a halide solution.

b. A halide solution contains protective colloid. The concentration of protective colloid is 0.4% or more, preferably from 1% to 20%.

c. A silver salt solution contains protective colloid. The concentration of protective colloid is 0.4% or more, preferably from 1% to 20%. When gelatin is used as protective colloid, as gelatin silver is made from a silver ion and gelatin and silver colloid is formed by photolysis and pyrolysis thereof, a silver salt aqueous solution and a gelatin solution are preferably added immediately before use.

The above methods a, b and c may be used alone, in combination, or three methods may be used at the same time.

Gelatin is often used as protective colloid in the present invention, and alkali-processed gelatin is generally used. In particular, gelatin subjected to deionization processing, that is, gelatin from which impurity ions and impurities are removed, and alkali-processed gelatin subjected to ultrafiltration processing are preferably used. In addition to alkali-processed gelatin, derivative gelatin such as acid-processed gelatin, phthalated gelatin, trimellited gelatin, succinated gelatin, maleated gelatin, and esterified gelatin, low molecular weight gelatin (molecular weight of from 1,000 to 80,000, including enzyme-decomposed gelatin, acid- and/or alkali-hydrolyzed gelatin, thermal decomposed gelatin), high molecular weight gelatin (molecular weight of from 110,000 to 300,000), gelatin having a methionine content of 40 $\mu$mol/g or less, gelatin having a thyrosin content of 20 $\mu$mol/g or less, oxidized gelatin, and gelatin in which methionine is inactivated by alkylation can be used. Mixture of two or more gelatins can be used. For forming finer grains in a mixing vessel, the temperature of the mixing vessel is necessary to be maintained low but gelatin is liable to solidify at 35° C. or less, therefore, it is preferred to use low molecular weight gelatin which does not solidify at low temperature. The molecular weight of gelatin is 50,000 or less, preferably 30,000 or less, and more preferably 10,000 or less. Synthetic high polymers having the function of protective colloid are also used in the present invention as they do not solidify at low temperature. Further, natural high polymers besides gelatin can also be used in the present invention. With respect to them, JP-B-7-111550 and *Research Disclosure*, Vol. 176, No. 17643, item IX (December, 1978) can be referred to.

Trimellited gelatin preferably used in the present invention can be obtained by reacting trimellitic anhydride with gelatin at pH 9.

Succinated gelatin preferably used in the present invention can be obtained by reacting succinic anhydride with gelatin at pH 8.

Maleated gelatin preferably used in the present invention can be obtained by reacting maleic anhydride with gelatin at pH 8.

For obtaining finer grains in a mixing vessel, the temperature of the mixing vessel is preferably maintained low, preferably 40° C. or less and more preferably 35° C. or less.

The formation of tabular grains according to the present invention comprises the following processes:

(1) Nucleation

A silver ion, a halide ion and a gelatin solution are added to a mixing vessel and extremely fine grains are formed. The size of extremely fine grains and crystallo-graphical structure (the ratio of regular crystal and twin crystal) of grains are determined by the formation condition at this time. Characteristics of these grains are determined by the formation condition of fine grains, and pAg, temperature, addition rates of a silver ion and a halide ion, concentration of gelatin, etc., at formation of these fine grains are adjusted for that purpose. The emulsion discharged from the mixing vessel is frozen with liquid nitrogen and put on a mesh for observation and the size of fine grains can be confirmed by a transmission type electron microscope. Magnifications of observation are preferably from 20,000 to 40,000 magnifications. The fine grain size of the present invention is 0.05 μm or less, preferably 0.03 μm or less, and more preferably 0.01 μm or less.

(2) Ripening

The fine grain emulsion discharged from the mixing vessel is reserved in other container and added later to a reaction vessel or directly and continuously added from the mixing vessel to a reaction vessel. At this time, the temperature in the reservoir or the reaction vessel is maintained at 50° C. or less, preferably 40° C. or less, to prevent the alteration of fine grains to the utmost. After completion of the addition of the fine grain emulsion, ripening is conducted by increasing the temperature and the pAg. Regular crystals mixed in the nucleus emulsion can be vanished and tabular grain nuclei which are twin crystals can be left through these processes. The temperature of ripening is 45° C. or more, preferably 50° C. or more.

(3) Growth

After tabular grain nuclei are formed, a silver ion, a halide ion and a gelatin solution are added to the mixing vessel to form extremely fine grains, and the fine grain emulsion is continuously added to the reaction vessel. It is requisite that all the added fine grains at this time be dissolved in the reaction vessel to release silver ions and halide ions, and it is necessary to maintain the temperature in the reaction vessel high for that purpose. The temperature in the reaction vessel is 50° C. or more, preferably 60° C. or more, and more preferably 70° C. or more. The pAg in the reaction vessel is 8 or more. A silver halide solvent can be used for increasing the dissolution rate of fine grains. The feed rate of a silver ion and a halide ion may be constant, or may be increased with the time with the progress of the grain growth. The increase may be conducted in the primary relationship with the time, secondary relationship, or may be intermediate.

A tabular grain emulsion of thin grain thickness and having a narrow grain size distribution can be obtained according to the present invention. Fine grains produced by the mixing vessel of the present invention which has completely dissolved the conventional problems are finer and the homogeneity of fine grains is high by far. Accordingly, tabular grains produced by the mixing vessel of the present invention are thin in thickness-and narrow in the grain size distribution as compared with those produced by conventional methods. When tabular grains are mixed crystals, that is, when they comprise silver iodobromide, silver chlorobromide, silver chloroiodobromide or silver iodochloride, the completely homogeneous halide composition can also be realized. This complete homogeneity can be easily confirmed by a direct transmission photographing using a low temperature microscope as disclosed in JP-B-7-23218. According to the present invention, completely homogeneous tabular grains having a thickness of from 0.01 μm to less than 0.1 μm, preferably from 0.03 μm to less than 0.07 μm, and a monodisperse equivalent-circle diameter of the projected area can easily be produced.

Monodispersion in the present invention means the variation coefficient of the equivalent-circle diameter corresponding to the projected area of tabular grains is 25% or less, preferably 20% or less. The variation coefficient thereof is the value obtained by dividing the standard deviation of the equivalent-circle diameter of grains by the average equivalent-circle diameter and multiplying 100.

Tabular grains for use in the present invention have an aspect ratio of from 5 or more to less than 100, preferably from 20 or more to less than 70. The average aspect ratio is the value obtained by dividing the average equivalent-circle diameter by the average thickness of grains.

In the present invention, the projected area of tabular grains having an aspect ratio of 5 or more occupies from 50% to 99.5%, preferably from 80% to 99.5%, and more preferably from 90% to 99.5%, of the entire projected area.

Furthermore, the tabular grain emulsion having the thickness of 0.1 μm or more, complete homogeneous halide composition and narrow grain size distribution can be obtained according to the present invention. For controlling the tabular grain thickness, the adjustment of the pAg and the temperature during ripening process and/or the use of a silver halide solvent can be applied.

For obtaining regular crystals in the present invention, grain formation is conducted by the following processes.

(1) Nucleation

Extremely fine grains are formed by the addition of a silver salt solution, a halide solution and a gelatin solution to a mixing vessel the same as in the case of tabular grains but at this time it is necessary so as to contain no twin crystals in the nucleus emulsion. This can be actualized by high pAg, high temperature, high gelatin concentration, a low degree of supersaturation (the addition rates of silver and halide are lowered) and vigorous stirring at the time of nucleation.

(2) Ripening

In regular crystal formation, this process is generally not necessary but when controlling of the number of nuclei is required, this process becomes necessary. A silver halide solvent can be used for the control of the number of nuclei.

(3) Growth

The method is fundamentally the same as the case of tabular grain growth. The different point from the case of tabular grain growth is that it is important so as not to include twin crystal nuclei in a reaction vessel. This can also be actualized by high pAg, high temperature, high gelatin concentration, a low degree of supersaturation and vigorous stirring.

According to these processes, a monodisperse regular crystal grain emulsion having a complete homogeneous halide composition and narrow grain size distribution can be obtained.

Examples of silver halide solvents for use in the present invention include water-soluble bromide, water-soluble chloride, thiocyanate, ammonia, thioether and thioureas.

For example, thiocyanates (e.g., U.S. Pat. Nos. 2,222,264, 2,448,534, 3,320,069), ammonia, thioether compounds (e.g., U.S. Pat. Nos. 3,271,157, 3,574,628, 3,704,130, 4,297,439, 4,276,347), thione compounds (e.g., JP-A-53-144319, JP-A-53-82408, JP-A-55-77737), amine compounds (e.g., JP-A-54-100717), thiourea derivatives (e.g., JP-A-55-2982), imidazoles (e.g., JP-A-54-100717), substituted mercaptotetrazoles (e.g., JP-A-57-202531) can be cited.

According to the method of the present invention, the feed rates of a silver ion and a halide ion to a mixing vessel can be controlled freely. The feed rate may be constant but preferably the feed rate is gradually increased. With respect to such the methods, JP-B-48-36890 and JP-B-52-16364 can be referred to. Further, according to the method of the present invention, a halogen composition during growing can be freely controlled, for example, in the case of silver iodide, it is possible to maintain the content of silver iodide constant, increase or decrease the content of silver iodide continuously, or change the content of silver iodide at a certain point. Gelatin is advantageously used as protective colloid to be added to the mixing vessel according to the present invention, but other hydrophilic colloids can also be used, for example, those disclosed in *Research Disclosure*, Vol. 176, No. 17643, item IX (December, 1978).

Completely uniform mixed crystal grains can be obtained according to the present invention but the present invention is also very effective for grains other than mixed crystals, e.g., silver bromide and silver chloride. According to conventional methods, mixing in a mixing vessel is not sufficient and silver ions and halide ions in a mixing vessel are not homogeneous, therefore, extremely fine silver halide grains have to pass through such nonuniform parts. In particular, reduced silver or fogged silver is produced at the part where silver ion concentration is high. These extremely fine grains are added in a reaction vessel after formation and then occur nucleation and/or growth, and a silver speck or fogged silver is incorporated into silver halide grains at that time. This problem has been solved by the present invention and it has become possible to prevent mixing of an unnecessary silver speck to silver halide grains.

The silver halide emulsion for use in the present invention is a surface latent image type emulsion, an internal latent image type emulsion, or a direct reversal emulsion.

In general, an internal latent image-forming type silver halide grain is superior to a surface latent image-forming type silver halide grain in the following points.

(1) A space charge layer is formed on a silver halide grain and an electron generated by light absorption proceeds to the inside of the grain and a positive hole proceeds to the surface, accordingly, if a latent image site (an electron trap site), that is, a sensitivity speck, is provided inside the grain, rebinding can be prevented and latent image formation can be conducted efficiently and high quantum sensitivity can be realized.

(2) As a sensitivity speck exists inside a grain, the sensitive nucleus is not affected by water and oxygen and is excellent in storage stability.

(3) As a latent image formed by exposure also exists inside a grain, the latent image is not affected by water and oxygen and has a very excellent latent image stability.

(4) When a sensitizing dye is adsorbed onto the surface of a grain and the emulsion is spectral sensitized, a light absorption site (a sensitizing dye on the surface) and a latent image site (a sensitivity speck of the inside) are separated, accordingly, rebinding of a dye hole and an electron can be prevented, so-called intrinsic desensitization due to spectral sensitization does not occur, and high spectral sensitization sensitivity can be actualized.

Thus, an internal latent image forming type grain has advantages as compared with a surface latent image forming type grain, on the contrary, there exists a difficulty of incorporation of a sensitivity speck into the inside of a grain. For the incorporation of a sensitivity speck inside a grain, after a grain to become a core is once formed, then chemical sensitization is conducted to form a sensitivity speck on the surface of the core. Silver halide is deposited on the core and so-called shell formation is conducted. However, the sensitivity speck on the surface of the core grain obtained by chemical sensitization of the core is liable to be altered at the time of forming a shell and easily converts to internal fog. One of reasons is presumably because when shell formation on the core occurs at the part of uneven concentration (silver ion concentration and halide ion concentration) as conventional cases, the sensitivity speck is impaired and prone to convert to a fog speck. This problem can be solved according to the method of the present invention and an internal latent image-forming type silver halide emulsion hardly having internal fog can be obtained. Regular crystal and tabular grains are preferred as an internal latent image-forming type silver halide emulsion, further, silver bromide, silver iodide, and silver chlorobromide and silver chloroiodide having a silver chloride content of 30 mol % or less, are preferred. Particularly, silver iodobromide having a silver iodide content of 10 mol % or less is preferred.

In this case, the molar ratio of core/shell may be arbitrary but is preferably from 1/20 to 1/2, more preferably from 1/10 to 1/3.

Instead of or in combination with an internal chemical sensitization speck, a metal ion can be doped inside a grain. The position of doping may be a core, the interface of core/shell, or may be a shell.

As a metal dopant, a cadmium salt, a lead salt, a thallium salt, an erbium salt, a bismuth salt, an iridium salt, a rhodium salt or complex salts of these compounds can be used. A metal ion is generally used at the rate of $10^{-6}$ mol or more per mol of silver halide.

The grain size of the completely homogeneous silver halide emulsion grains according to the present invention is not particularly limited but is preferably 0.3 $\mu$m or more, more preferably 0.8 $\mu$m or more, and particularly preferably 1.4 $\mu$m or more.

The silver halide grains according to the present invention may have a regular crystal form such as a hexahedral, octahedral, dodecahedral, tetradecahedral, tetracosahedral, or octatetracontahedral form, an irregular crystal form such as a spherical or pebble-like form, or may be grains of various forms having one or more twin planes, e.g., hexagonal tabular grains having two or three parallel twin planes and triangular tabular twin crystal grains.

In the preparation of silver halide emulsion, additives which can be added from the grain formation until coating are not limited, in particular.

A silver halide solvent can be used to accelerate the growth during the crystal forming process and to increase the effect of chemical sensitization during the grain formation and/or chemical sensitization. Examples of silver halide solvents which can be used in the present invention include water-soluble thiocyanate, ammonia, thioether and thioureas. Concrete examples of the silver halide solvents include thiocyanates (as described in U.S. Pat. Nos. 2,222,264, 2,448,534, 3,320,069), ammonia, thioether compounds (as described in U.S. Pat. Nos. 3,271,157, 3,574,628, 3,704,130, 4,297,439, 4,276,347), thione compounds (as described in JP-A-53-144319, JP-A-53-82408, JP-A-55-77737), amine compounds (as described in JP-A-54-100717), thiourea derivatives (as described in JP-A-55-2982), imidazoles (as described in JP-A-54-100717), and substituted mercaptotetrazoles (as described in JP-A-57-202531).

A silver halide emulsion is in general spectrally sensitized. Methine dyes are usually used as a spectral sensitizing dye. Examples of the methine dyes include a cyanine dye, a merocyanine dye, a complex cyanine dye, a complex merocyanine dye, a holopolar cyanine dye, a hemicyanine dye, a styryl dye, and a hemioxonol dye. Rings which are usually utilized as basic heterocyclic rings in cyanine dyes can be applied to these dyes. Examples of the basic heterocyclic rings include a pyrroline ring, an oxazoline ring, a thiazoline ring, a pyrrole ring, an oxazole ring, a thiazole ring, a selenazole ring, an imidazole ring, a tetrazole ring, and a pyridine ring. Further, heterocyclic rings to which alicyclic hydrocarbon rings and aromatic hydrocarbon rings are condensed can also be used. Examples of the condensed rings include an indolenine ring, a benzindolenine ring, an indole ring, a benzoxazole ring, a naphthoxazole ring, a benzimidazole ring, a benzothiazole ring, a naphthothiazole ring, a benzoselenazole ring, and a quinoline ring. These rings may have a substituent on the carbon atoms.

A 5- or 6-membered heterocyclic ring having a ketomethylene structure can be applied to a merocyanine dye or a complex merocyanine dye. Examples of such the heterocyclic rings include a pyrazolin-5-one ring, a thiohydantoin ring, a 2-thiooxazolidine-2,4-dione ring, a thiazolidine-2,4-dione ring, a rhodanine ring, and a thiobarbituric acid ring.

A sensitizing dye is preferably added in an amount of from 0.001 to 100 mmol, more preferably from 0.01 to 10 mmol, per mol of silver halide.

A sensitizing dye is preferably added during chemical sensitization or before chemical sensitization (e.g., during grain formation or physical ripening).

Dyes which themselves do not have a spectral sensitizing function or substances which substantially do not absorb visible light but show supersensitization can be contained in a silver halide emulsion with sensitizing dyes. Examples of such the dyes or substances include aminostilbene compounds substituted with a nitrogen-containing heterocyclic group (e.g., those disclosed in U.S. Pat. Nos. 2,933,390 and 3,635,721), aromatic organic acid-formaldehyde condensation products (those disclosed in U.S. Pat. No. 3,743,510), cadmium salts and azaindene compounds. The combinations of sensitizing dyes with the above dyes or substances are disclosed in U.S. Pat. Nos. 3,615,613, 3,615,641, 3,617,295 and 3,635,721.

A silver halide emulsion is in general chemically sensitized before use. As chemical sensitization, chalcogen sensitization (sulfur sensitization, selenium sensitization, tellurium sensitization), noble metal sensitization (gold sensitization) and reduction sensitization are used alone or in combination.

In sulfur sensitization, labile sulfur compounds are used as a sensitizer. The labile sulfur compounds are disclosed in P. Glafkides, *Chimie et Physique Photographique*, 5th Ed., Paul Montel (1987) and *Research Disclosure*, Vol. 307, No. 307105. Examples of the sulfur sensitizers include thiosulfates (e.g., hypo), thioureas (e.g., diphenylthiourea, triethylthiourea, N-ethyl-N'-(4-methyl-2-thiazolyl)thiourea, carboxymethyltrimethylthiourea), thioamides (e.g., thioacetamide), rhodanines (e.g., diethyl rhodanine, 5-benzylidene-N-ethyl rhodanine), phosphine sulfides (e.g., trimethylphosphine sulfide), thiohydantoins, 4-oxooxazolidine-2-thiones, dipolysulfides (e.g., dimorpholine disulfide, cystine, hexathiocanethione), mercapto compounds (e.g., cysteine), polythionate, and elemental sulfur. Active gelatins can also be used as a sulfur sensitizer.

In selenium sensitization, labile selenium compounds are used as a sensitizer. The labile selenium compounds are disclosed in JP-B-43-13489, JP-B-44-15748, JP-A-4-25832, JP-A-4-109240, JP-A-4-271341, and JP-A-5-40324. Examples of the selenium sensitizers include colloidal metal selenium, selenoureas (e.g., N,N-dimethylselenourea, trifluoromethylcarbonyltrimethylselenourea, acetyltrimethylselenourea), selenoamides (e.g., selenoacetamide, N,N-diethylphenylselenoamide), phosphineselenides (e.g., triphenylphosphineselenide, pentafluorophenyltriphenylphosphineselenide), selenophosphates (e.g., tri-p-tolylselenophosphate, tri-n-butylselenophosphate), seleno ketones (e.g., selenobenzophenone), isoselenocyanates, selenocarboxylic acids, seleno esters, and diacylselenides. In addition, comparatively stable selenium compounds such as selenious acid, potassium selenocyanate, selenazoles and selenides (disclosed in JP-B-46-4553 and JP-B-52-34492) can also be used as a selenium sensitizer.

Labile tellurium compounds are used as a tellurium sensitizer in tellurium sensitization. Labile tellurium compounds are disclosed in Canadian Patent 800,958, British Patents 1,295,462, 1,396,696, JP-A-4-204640, JP-A-4-271341, JP-A-4-333043, and JP-A-5-303157. Examples of the tellurium sensitizers include telluroureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxydiphenylphosphinetelluride), diacyl(di)tellurides (e.g., bis(diphenylcarbamoyl)ditelluride, bis(N-phenyl-N-methylcarbamoyl)-ditelluride, bis(N-phenyl-N-methylcarbamoyl)telluride, bis-(ethoxycarbonyl)telluride), isotellurocyanatos, telluroamides, tellurohydrazines, telluro esters (e.g., butylhexyltelluro ester), telluro ketones (e.g., telluroacetophenone), colloidal tellurium, (di)tellurides, and other tellurium compounds (e.g., potassium telluride, sodium telluropentathionate).

In noble metal sensitization, noble metal salts of gold, platinum, palladium, and iridium are used as a sensitizer. Noble metal salts are disclosed in P. Glafkides, *Chimie et Physique Photoqraphigue*, 5th Ed., Paul Montel (1987) and *Research Disclosure*, Vol. 307, No. 307105. Gold sensitization is particularly preferred. As described above, the effect of the present invention is particularly exhibited in the embodiment of conducting gold sensitization.

There are disclosed in *Photographic Science and Engineering*, Vol. 19322 (1975) and *Journal of Imaging Science*, Vol. 3228 (1988) that gold can be removed from the sensitization speck on an emulsion grain using a solution containing potassium cyanide (KCN). According to these descriptions, a cyanide ion makes a gold atom or a gold ion adsorbed onto a silver halide grain isolate as a cyanide complex to hinder gold sensitization. The action of gold sensitization can be sufficiently obtained by suppressing generation of cyanogen according to the present invention.

Examples of gold sensitizers include chloroauric acid, potassium chloroaurate, potassium aurithiocyanate, gold sulfide, and gold selenide, as well as gold compounds disclosed in U.S. Pat. Nos. 2,642,361, 5,049,484 and 5,049,485.

Reducing compounds are used as a sensitizer in reduction sensitization. Reducing compounds are disclosed in P. Glafkides, *Chimie et Physique Photographique*, 5th Ed., Paul Montel (1987), and *Research Disclosure*, Vol. 307, No. 307105. Examples of reducing compounds include aminoiminomethanesulfinic acid (thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfite, aldehyde compounds, and hydrogen gas. Reduction sensitization can be carried out in the atmosphere of high pH and excessive silver ion (so-called silver ripening).

Chemical sensitization may be conducted in combination of two or more. A combination of chalcogen sensitization with gold sensitization is particularly preferred. Reduction sensitization is preferably conducted during silver halide grain formation. The amount of a sensitizer used is in general determined according to the kind of silver halide grains to be used and the conditions of chemical sensitization.

The amount of a chalcogen sensitizer used is generally from $10^{-8}$ to $10^{-2}$ mol, preferably from $10^{-7}$ to $5\times10^{-3}$ mol per mol of silver halide.

The amount of a noble metal sensitizer used is preferably from $10^{-7}$ to $10^{-2}$ mol per mol of silver halide.

The conditions of chemical sensitization are not particularly limited. pAg is in general from 6 to 11, preferably from 7 to 10, pH is preferably from 4 to 10, and temperature is preferably from 40 to 95° C., and more preferably from 45 to 85° C.

Various compounds can be added to a silver halide emulsion for preventing generation of fog or stabilizing photographic capabilities during production, storage or processing of the photographic material. Examples of such the compounds include azoles [e.g., benzothiazolium salt, nitroindazoles, triazoles, benzotriazoles, benzimidazoles (in particular, nitro- or halogen-substituted benzimidazoles)]; heterocyclic mercapto compounds [e.g., mercaptothiazoles, mercaptobenzothiazoles, mercaptobenzimidazoles, mercaptothiadiazoles, mercaptotetrazoles (in particular, 1-phenyl-5-mercaptotetrazoles), mercaptopyrimidines]; the above heterocyclic mercapto compounds having a water-soluble group such as a carboxyl group or a sulfone group; thioketo compounds [e.g., oxazolinethione]; azaindenes [e.g., tetraazaindenes (in particular, 4-hydroxy-substituted-(1,3,3a,7)tetraazaindenes)); benzenethiosulfonic acids; and benzenesulfinic acids. These compounds are in general known as antifoggants or stabilizers.

The antifoggants or stabilizers are, in general, added after chemical sensitization. However, they may be added during chemical sensitization or before start of chemical sensitization. That is, they can be added at any time during silver halide emulsion grain forming process, e.g., during addition of a silver salt solution, during the period after the addition and before start of chemical sensitization, or during chemical sensitization (preferably within the time up to 50% from the start, more preferably within the time up to 20% from the start).

The layer structure of a silver halide photographic material is not particularly limited. However, a color photographic material comprises a multilayer structure, as blue, green and red light are recorded separately. Each silver halide emulsion layer may consist of two layers of a high speed layer and a low speed layer.

Examples of practical layer structures (1) to (6) are shown below.

(1) BH/BL/GH/GL/RH/RL/S
(2) BH/BM/BL/GH/GM/GL/RH/RM/RL/S
(3) BH/BL/GH/RH/GL/RL/S
(4) BH/GH/RH/BL/GL/RL/S
(5) BH/BL/CL/GH/GL/RH/RL/S
(6) BH/BL/GH/GL/CL/RH/RL/S

B represents a blue-sensitive layer, G a green-sensitive layer, R a red-sensitive layer, H the highest speed layer, M a middle speed layer, L a low speed layer, S a support, and CL represents an interlayer effect imparting layer. Light-insensitive layers such as a protective layer, a filter layer, an interlayer, an antihalation layer, and a subbing layer are omitted. The arrangement of a high speed layer and a low speed layer having the same color sensitivity may be reversed.

With respect to (3), U.S. Pat. No. 4,184,876 can be referred to, as to (4), in RD, No. 22534, JP-A-59-177551 and JP-A-59-177552, and (5) and (6) are disclosed in JP-A-61-34541.

Preferred layer structures are (1), (2) and (4).

The silver halide photographic material according to the present invention can also be applied to, in addition to color photographic materials, photographic materials for X-ray, black-and-white photographic materials for photographing, process photographic materials, and photographic printing paper.

With respect to various additives for use in silver halide emulsions (e.g., binders, chemical sensitizers, spectral sensitizers, stabilizers, gelatin hardening agents, surfactants, antistatic agents, polymer latexes, matting agents, color couplers, ultraviolet absorbers, discoloration inhibitors, dyes), supports of photographic materials and processing methods of photographic materials (e.g., coating methods, exposing methods, development processing methods), descriptions in *Research Disclosure*, Vol. 176, Item 17643 (RD 17643), ibid., Vol. 187, Item 18716 (RD 18716) and ibid., Vol. 225, Item 22534 (RD 22534) can be referred to.

These descriptions in *Research Disclosures* are listed in the following table.

| Type of Additives | RD 17643 | RD 18716 | RD 22534 |
|---|---|---|---|
| 1. Chemical Sensitizers | page 23 | page 648, right column | page 24 |
| 2. Sensitivity Increasing Agents | — | page 648, right column | — |
| 3. Spectral Sensitizers and Supersensitizers | pages 23–24 | page 648, right column to page 649, right column | pages 24–28 |
| 4. Brightening Agents | page 24 | — | — |
| 5. Antifoggants and Stabilizers | pages 24–25 | page 649, right column | pages 24 and 31 |
| 6. Light Absorbers, Filter Dyes, and Ultraviolet Absorbers | pages 25–26 | page 649, right column to page 650, left column | — |

-continued

| Type of Additives | RD 17643 | RD 18716 | RD 22534 |
|---|---|---|---|
| 7. Antistaining Agents | page 25, right column | page 650, left to right columns | — |
| 8. Dye image Stabilizers | page 25 | — | page 32 |
| 9. Hardening Agents | page 26 | page 651, left column | page 28 |
| 10. Binders | page 26 | page 651, left column | — |
| 11. Plasticizers and Lubricants | page 27 | page 650, right column | — |
| 12. Coating Aids and Surfactants | pages 26–27 | page 650, right column | — |
| 13. Antistatic Agents | page 27 | page 650, right column | — |
| 14. Color Couplers | page 25 | page 649 | page 31 |

As gelatin hardening agents, active halide compounds (e.g., 2,4-dichloro-6-hydroxy-1,3,5-triazine and sodium salts thereof) and active vinyl compounds (e.g., 1,3,-bisvinyl-sulfonyl-2-propanol, 1,2-bis (vinylsulfonylacetamido)ethane, or vinyl polymers having a vinylsulfonyl group at side chain) are preferred as they rapidly harden hydrophilic colloid such as gelatin and provide stable photographic characteristics. N-carbamoyl pyridinium salts [e.g., 1-morpholinocarbonyl-3-pyridinio) methanesulfonate] and haloamidinium salts (e.g., 1-(1-chloro-1-pyridinomethylene)pyrrolidinium 2-naphthalenesulfonate] are also excellent in view of rapid hardening ability.

Color photographic materials can be developmentprocessed according to ordinary methods disclosed in RD, No. 17643, pages 28 and 29 and ibid., No. 18716, page 651, from left column to right column.

The color photographic materials are in general subjected to washing processing or stabilization processing after development, blixing or fixation processing.

The washing processing is usually conducted in a countercurrent system with two or more tanks in a view of saving water. As the stabilization processing, multistage countercurrent stabilization processing as disclosed in JP-A-57-8543 may be conducted instead of washing processing.

The present invention is described with reference to specific examples but it should not be construed as being limited thereto.

EXAMPLE 1

Preparation of Pure Silver Bromide Tabular Grain Emulsion

Emulsion 1-A (Comparison)

Tabular grains were prepared as described below using the conventional mixing vessel shown in FIG. 5 according to the producing process shown in FIG. 2.

To a reaction vessel 1 were added 1.0 liter of water, 3 g of low molecular weight ossein gelatin (average molecular weight: 20,000) and 0.5 g of KBr and dissolved, the solution was maintained at 40° C. While stirring the solution, 10 ml of a 0.5 M silver nitrate solution and 20 ml of a 0.3 M KBr solution were added thereto over 40 seconds, followed by the addition of 22 ml of a 0.8 M KBr solution. The temperature was then raised to 75° C. and ripening was carried out for 5 minutes. A 10 wt % aqueous solution containing oxidized ossein gelatin (methionine content: 5 μmol/g) was added thereto. Subsequently, 1,000 ml of a 0.53 M silver nitrate solution and 1,000 ml of a 0.54 M KBr solution containing 5 wt % of low molecular weight gelatin (average molecular weight: 20,000) were added to a mixing vessel 7 over 60 minutes. Fine grain emulsion formed in the mixing vessel was continuously added to the reaction vessel. The capacity of the mixing vessel was 5 ml and the rotation speed of stirring of the mixing vessel was as shown in Table 1. The temperature of the reaction vessel was maintained 75° C. After completion of the addition, the temperature of the emulsion was lowered to 35° C., the emulsion was washed according to an ordinary flocculation method, 70 g of lime-processed ossein gelatin was added and dissolved and pAg and pH were adjusted to 8.7 and 6.5, respectively. The thus-obtained Emulsion 1-A was stored in a cold dark room. Characteristics of tabular grain Emulsion 1-A are shown in Table 1.

Emulsion 1-B (Invention)

Emulsion 1-B was prepared in the same manner as the preparation of Emulsion 1-A except for using the mixing vessel of the present invention shown in FIG. 1. The rotation speeds of stirring and the results obtained are shown in Table 1. It is understood from the results that the grain size distribution became narrower and preferred results were obtained, according to the present invention.

Emulsion 1-C (Invention)

Emulsion 1-C was prepared using the mixing vessel of the present invention shown in FIG. 1, but in this case, one of two stirring blades disposed at the top and bottom ends of the stirring tank confronting with each other was taken away and mixing was carried out by one stirring blade. The rotation speeds of stirring and the results obtained are shown in Table 1.

TABLE 1

| | Characteristics of Tabular Grains | | | | |
|---|---|---|---|---|---|
| Emulsion | Rotation Speed of Stirring (rpm) | Average Equivalent-Circle Diameter (μm) | Average Thickness (μm) | Variation Coefficient (%) | Remarks |
| 1-A | 1,000 | 1.42 | 0.055 | 26 | Comparison |
| 1-A | 3,000 | 1.45 | 0.055 | 24 | Comparison |
| 1-A | 6,000 | — | — | — | Comparison |
| 1-B | 1,000 | 1.43 | 0.05 | 23 | Invention |
| 1-B | 3,000 | 1.52 | 0.05 | 19 | Invention |
| 1-B | 6,000 | 1.54 | 0.045 | 17 | Invention |
| 1-C | 1,000 | 1.45 | 0.055 | 25 | Invention |
| 1-C | 3,000 | 1.46 | 0.055 | 22 | Invention |
| 1-C | 6,000 | 1.47 | 0.05 | 20 | Invention |

In Table 1, the equivalent-circle diameter represents a diameter of a circle when the projected area of a tabular grain is calculated in terms of a circle, and variation coefficient is the value obtained by dividing the standard deviation of the equivalent-circle diameter by the average equivalent-circle diameter and multiplying 100.

In Table 1, Emulsions 1-B and 1-C, emulsions of the present invention, could be stirred by 6,000 rpm, but with respect to comparative Emulsion 1-A according to a conventional method, the leakage of the solution at the sealed part of the rotary shaft occurred and the experiment could not help giving up. From the results in Table 1, it can be seen that a thin tabular grain emulsion having a narrow grain size distribution can be obtained by high speed rotation in a mixing vessel. On the other hand, when Emulsions 1-B and 1-C of the present invention are compared, it is seen that the degree of monodispersion is higher in Emulsion 1-B which was prepared by rotating opposite stirring blades conversely. This is presumably because stronger and higher stirring could not be conducted in Emulsion 1-C as the vacancy was generated in the central part of the mixing vessel due to high speed rotation.

EXAMPLE 2

Preparation of Silver Iodobromide Tabular Grain Emulsion

Emulsion 2-A (Comparison)

Tabular grains were prepared as described below using the conventional mixing vessel shown in FIG. 5 (capacity of the mixing vessel: 8 ml) according to the producing process shown in FIG. 2. In this example, both nucleation and grain growth were conducted in the mixing vessel.

To a reaction vessel 1 were added 1.0 liter of water and 2 g of low molecular weight ossein gelatin (average molecular weight: 10,000) and dissolved, the solution was maintained at 35° C. Subsequently, 50 ml of a 0.6 M silver nitrate aqueous solution and 200 ml of a 0.16 M KBr aqueous solution containing 0.8 wt % of low molecular weight gelatin were added to a mixing vessel 7 over 2 minutes. The emulsion produced was continuously added to the reaction vessel over 2 minutes. The rotation speed of stirring of the mixing vessel was 2,000 rpm. (Nucleation)

Three hundred (300) ml of a solution containing 10% ossein gelatin in which 95% of the amino group was phthalated and KBr were added to the reaction vessel and pBr was adjusted to 2.1, followed by the increase of the temperature to 75° C. and the emulsion was allowed to stand for 5 minutes. (Ripening)

Subsequently, 600 ml of a 1.0 M silver nitrate aqueous solution, 600 ml of a 0.99 M KBr aqueous solution containing 3 mol % of KI and 800 ml of an aqueous gelatin solution containing 5% of low molecular weight gelatin were added to the mixing vessel at accelerated flow rate (the final flow rate was 4 times of the initial flow rate). Fine grain emulsion formed in the mixing vessel was continuously added to the reaction vessel. The rotation speed of stirring of the mixing vessel was 2,000 rpm. (The rotation speed of 6,000 rpm was also tested but the leakage of the solution at the sealed part of the rotary shaft occurred and the experiment could not be continued.) During grain growth, $8\times10^{-8}$ mol/mol-Ag of $IrCl_6$ was added for doping at the point when 70% of silver nitrate was added. Further, a yellow prussiate of potash solution was added to the mixing vessel before completion of grain growth. Yellow prussiate of potash was doped so as to 3% (in terms of silver amount added) of the shell part of the grain became the local concentration of $3\times10^{-4}$ mol/mol-Ag. After completion of the addition, the temperature of the emulsion was lowered to 35° C., the emulsion was washed according to an ordinary flocculation method, 70 g of lime-processed ossein gelatin was added and dissolved, and pAg and pH were adjusted to 8.7 and 6.5, respectively. The thus-obtained Emulsion 2-A was stored in a cold dark room. Characteristics of tabular grain Emulsion 2-A are shown in Table 2.

Emulsion 2-B (Invention)

Emulsion 2-B was prepared in the same manner as in Emulsion 2-A except for using the mixing vessel of the present invention shown in FIG. 1. However, the rotation speed of stirring at nucleation was the same as in Emulsion 2-A, but stirring during growth was changed, further, test was conducted with changing the rotation numbers of opposed two stirring blades. The results obtained are shown in Table 2.

TABLE 2

| | | Characteristics of Tabular Grains | | | |
|---|---|---|---|---|---|
| Emulsion | Rotation Speed of Stirring (rpm) | Average Equivalent-Circle Diameter (μm) | Average Thickness (μm) | Variation Coefficient (%) | Remarks |
| 2-A | 2,000 | 1.25 | 0.045 | 26 | Comparison |
| 2-B | 2,000 | 1.27 | 0.045 | 22 | Invention |
| 2-B | 6,000 | 1.30 | 0.042 | 18 | Invention |
| 2-B | 3,000 (top) 6,000 (bottom) | 1.29 | 0.042 | 18 | Invention |

As is apparent from the results in Table 2, the variation coefficient of the tabular grain size was reduced according to the present invention. It is seen from the results that tabular grains having the higher degree of monodispersion and thinner thickness can be obtained. Further, it is seen from the results in Table 2 that the rotation numbers of two stirring blades should not be necessarily the same in the mixing vessel according to the present invention. By the combination of 3,000 rpm and 6,000 rpm, no vacancy was generated at the central part of the mixing vessel due to high speed rotation as in conventional case where stirring was conducted by one stirring blade, and the mixing condition was good.

EXAMPLE 3

Emulsion 3-A (Comparison)

Tabular grains were prepared as described below using the mixing vessel shown in FIG. 5 according to the producing process shown in FIG. 2.

To the reaction vessel shown in FIG. 2 were added 1.0 liter of water, 5 g of low molecular weight gelatin (average molecular weight: 10,000) and 0.5 g of KBr and dissolved, the solution was maintained at 40° C. While stirring the solution, 10 ml of a 0.5 M silver nitrate solution and 20 ml of a 0.3 M KBr solution were added thereto over 40 seconds, followed by the addition of 22 ml of a 0.8 M KBr solution. The temperature was then raised to 75° C. and ripening was carried out for 10 minutes. 300 ml of a 10 wt % aqueous solution containing lime-processed ossein gelatin was added thereto. Subsequently, 1,000 ml of a 1 M silver nitrate solution and 1,000 ml of a 0.03 M KI and 0.99 M KBr solution containing 7 wt % of low molecular weight gelatin (average molecular weight: 20,000) were added to the mixing vessel shown in FIG. 5 over 80 minutes. Fine grain emulsion formed in the mixing vessel was continuously added to the reaction vessel. At that time, the rotation speed of stirring of the bottom of two opposite and conversely rotating stirring blades of the mixing vessel was 7,000 rpm and that of the top was 2,000 rpm. The potential of the emulsion during growing in the reaction vessel was −20 mV immediately before growth and 0 mV when the addition was completed. After completion of the addition, the temperature of the emulsion was lowered to 35° C., the emulsion was washed according to an ordinary flocculation method, 70 g of lime-processed ossein gelatin was added and dissolved. The thus-obtained Emulsion 3-A was stored in a cold dark room.

Emulsion 3-B (Invention)

Emulsion 3-B was prepared in the same manner as in Emulsion 3-A except for using a 10 wt % solution containing trimellited gelatin which was obtained by trimelliting lime-processed ossein gelatin (trimellition rate: 98%) in place of a 10 wt % solution containing lime-processed ossein gelatin and further using the mixing vessel of the present invention shown in FIG. 1.

Emulsion 3-C (Invention)

Emulsion 3-C was prepared in the same manner as in Emulsion 3-A except for using a 10 wt % solution containing succinated gelatin which was obtained by succinating lime-processed gelatin (succination rate: 98%) in place of a 10 wt % solution containing lime-processed ossein gelatin and further using the mixing vessel of the present invention shown in FIG. 1.

The results are shown in Table 3 below.

TABLE 3

| Emulsion | Average Equivalent-Circle Diameter (μm) | Average Thickness (μm) | Variation Coefficient of Equivalent-Circle Diameter (%) | Remarks |
|---|---|---|---|---|
| 3-A | 1.8 | 0.065 | 27 | Comparison |
| 3-B | 2.0 | 0.05 | 15 | Invention |
| 3-C | 2.0 | 0.055 | 16 | Invention |

As is apparent from the results of Table 3, as to tabular grains prepared using the mixing vessel of the present invention and trimellited gelatin or succinated gelatin, the thickness of the grain is thinner and the variation coefficient of equivalent-circle diameter is conspicuously small and monodisperse as compared with the tabular grains prepared using the conventional mixing vessel and gelatin not modified.

EXAMPLE 4

The following compound was added in an amount of $2.4\times10^{-4}$ mol/mol-Ag to Emulsions 2-A and 2-B prepared in Example 2 at 40° C. Subsequently, sodium thiosulfate, potassium chloroauric acid and potassium thiocyanate were added thereto at 60° C. and chemical sensitization was carried out optimally.

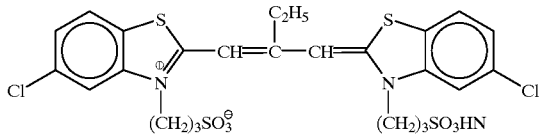

The emulsion and a protective layer were coated on a triacetate cellulose film support having an undercoat layer on the following condition to prepare a coated sample.

Condition of Emulsion Coating (1) Emulsion Layer

Emulsion: various emulsions ($3.6\times10^{-2}$ mol/m2 as Ag)

The following coupler ($1.5\times10^{-3}$ mol/m$^2$)

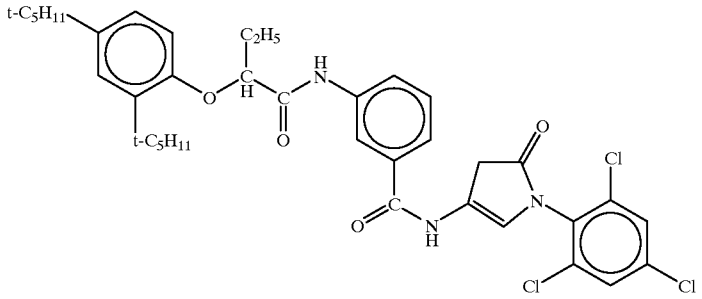

Tricresyl phosphate (1.10 g/m$^2$)

Gelatin (2.30 g/m$^2$)

(2) Protective Laver

Sodium 2,4-dichloro-6-hydroxy-s-triazine (0.08 g/m$^2$)

Gelatin (1.80 g/m$^2$)

Each of samples prepared was allowed to stand under the condition of 40° C. and 70% RH for 14 hours, then subjected to exposure for 1/100 sec. through a yellow filter and continuous wedge, and color development processed as follows.

Color Development

| Step | Processing Time | Processing Temperature (° C.) |
|---|---|---|
| Color Development | 2 min 00 sec | 40 |
| Blixing | 3 min 00 sec | 40 |
| Washing (1) | 20 sec | 35 |
| Washing (2) | 20 sec | 35 |
| Stabilization | 20 sec | 35 |
| Drying | 50 sec | 65 |

Composition of each processing solution are shown below.

| Color Developing Solution | |
|---|---|
| Diethylenetriaminepentaacetic Acid | 2.0 g |
| Sodium 1-Hydroxyethylidene-1,1-disulfonic sulfite | 4.0 g |
| Potassium Carbonate | 30.0 g |
| Potassium Bromide | 1.4 g |
| Potassium Iodide | 1.5 mg |

-continued

| Color Developing Solution | |
|---|---|
| Hydroxylamine Sulfate | 2.4 g |
| 4-(N-Ethyl-N-β-hydroxyethylamino)-2-methylaniline Sulfate | 4.5 g |
| Water to make | 1.0 l |
| pH | 10.05 |

| Blixing Solution | |
|---|---|
| Ammonium Ethylenediaminetetraacetato Ferrate Dihydrate | 90.0 g |
| Disodium Ethylenediaminetetraacetate | 5.0 g |
| Sodium Sulfite | 12.0 g |
| Aqueous Solution of Ammonium Thiosulfate (70%) | 260.0 ml |
| Acetic Acid (98%) | 5.0 ml |
| The following bleach accelerating agent | 0.01 mol |
| Bleach Accelerating Agent | |

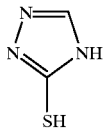

| | |
|---|---|
| Water to make | 1.0 l |
| pH | 6.0 |

Washing Water

City water was passed through a mixed bed column packed with an H-type cation exchange resin (Amberlite IR-120B of Rohm & Haas) and an OH-type anion exchange resin (Amberlite IR-400 of Rohm & Haas) and treated so as to reduce the calcium ion and magnesium ion concentrations to 3 mg/liter or less, subsequently 20 mg/liter of sodium isocyanurate dichloride and 1.5 g/liter of sodium sulfate were added thereto.

The pH of this washing water was in the range of from 6.5 to 7.5.

| Stabilizing Solution | |
|---|---|
| Formalin (37%) | 2.0 ml |
| Polyoxyethylene-p-monononylphenyl Ether (polymerization degree: 10) | 0.3 mg |
| Disodium Ethylenediaminetetraacetate | 0.05 mg |
| Water to make | 1.0 l |
| pH | 5.0 to 8.0 |

Sensitivity was the logarithm of the reciprocal of exposure amount to give density of (fog+0.1) represented by lux·sec. and expressed by the relative value. The results are shown in Table 4 below.

TABLE 4

| Emulsion | Sensitivity* | Fog | Gradation** | Remarks |
|---|---|---|---|---|
| 2-A | 100 | 0.06 | 1.3 | Comparison |
| 2-B | 110 | 0.06 | 1.7 | Invention |

*Sensitivity represents spectral sensitization sensitivity and expressed by the relative value of the reciprocal of exposure amount to give density of (fog + 0.1) with the value of Emulsion 2-A being taken as 100. The higher the value, the higher is the sensitivity.

**Gradation represents the gradient of the straight line of the characteristic curve obtained. The higher the value, the higher is the contrast. As is shown in the results of Table 4, the emulsion of the present invention is high in sensitivity and gradation. This is thought to be because the size distribution of tabular grains became monodisperse according to the present invention.

EXAMPLE 5

Preparation of Silver Chloride Tabular Grain Emulsion

Emulsion 4-A (Comparison)

Silver chloride tabular grains were prepared as described below using the conventional mixing vessel shown in FIG. 5 according to the producing process shown in FIG. 2.

To a reaction vessel 1 were added 1.0 liter of water, 1.5 g of ossein gelatin and 0.6 g of sodium chloride, the solution was maintained at 35° C. While stirring the solution, 60 ml of an aqueous solution of silver nitrate (silver nitrate: 9 g) and 60 ml of an aqueous solution of sodium chloride (sodium chloride: 3.1 g) were added thereto over 1 minute. One minute after from the completion of the addition, the following {111} growth modifier in an amount of 7 mmol and 40 ml of an aqueous solution of sodium chloride (sodium chloride: 4 g) were added, and the temperature was raised to 60° C. over 15 minutes.

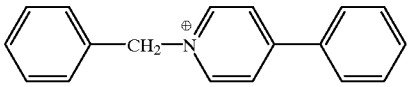

Figure 5:
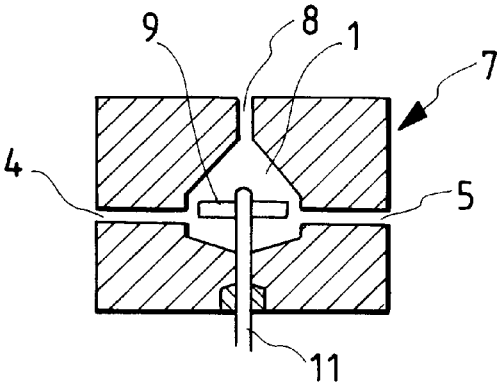
FIG. 5 is a schematic cross sectional view of a conventional mixing apparatus.
Figure 6:
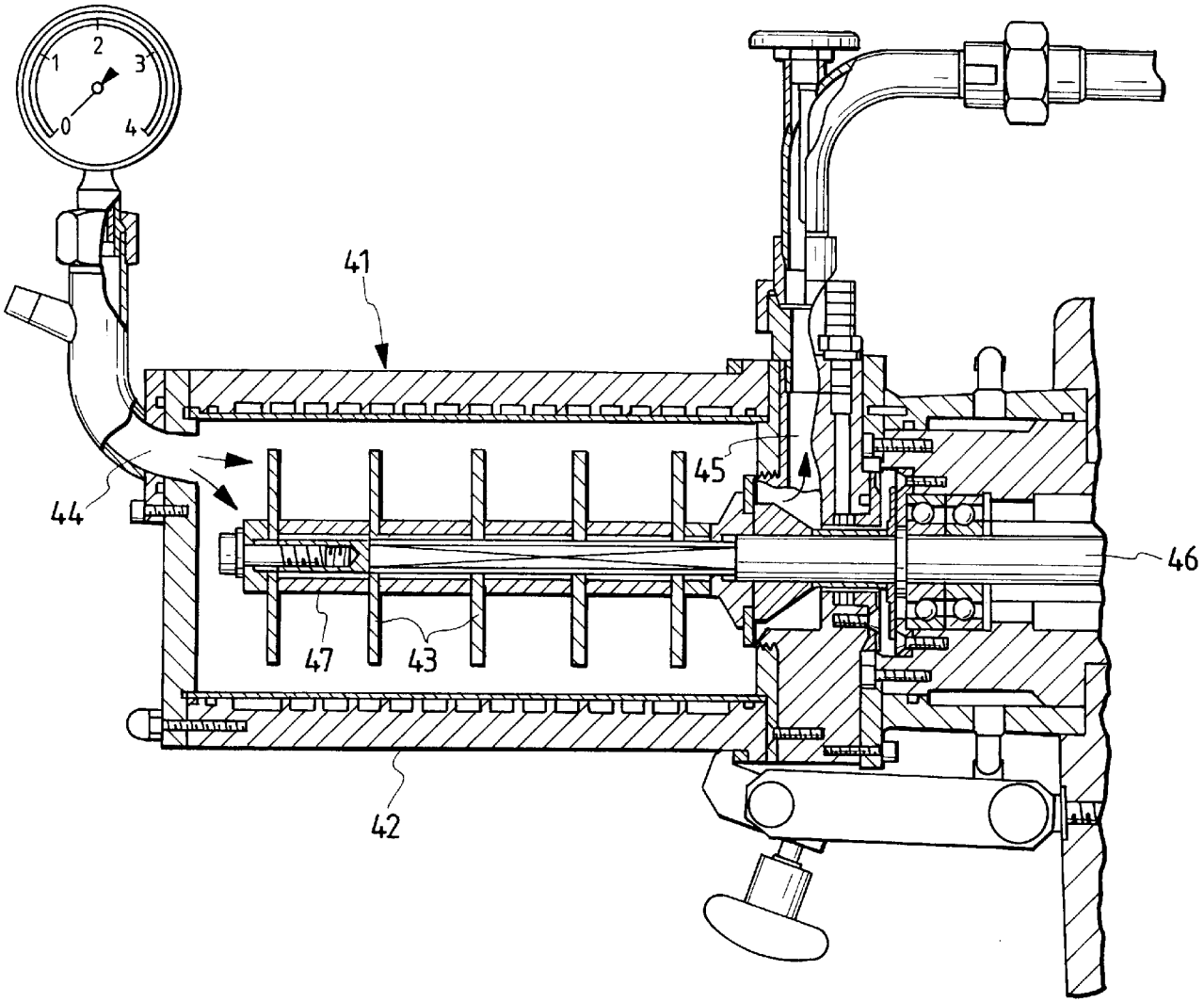
FIG. 6 is a concrete cross sectional view of a conventional mixing apparatus.

After ripening was conducted for 10 minutes, 1,000 ml of a 0.65 M silver nitrate solution and 1,000 ml of a 0.67 M sodium chloride solution containing 6 wt % of low molecular weight gelatin (average molecular weight: 10,000) were added to the mixing vessel shown in FIG. 5 at accelerated flow rate (the final flow rate was 4 times of the initial flow rate). Extremely fine grain silver chloride emulsion formed was continuously added to the reaction vessel. The capacity of the mixing vessel was 5 ml and the rotation speeds of stirring were 2,000 rpm and 5,000 rpm. However, in the experiment at 5,000 rpm, the leakage of the solution at the sealed part of the rotary shaft occurred and further the vacancy was generated in the central part of the mixing vessel due to high speed rotation, therefore, good mixing condition had not been realized. The results obtained are shown in Table 5.

Emulsion 4-B (Invention)

Emulsion 4-B was prepared in the same manner as in Emulsion 4-A except for using the mixing vessel of the present invention shown in FIG. 1. Two top and bottom stirring blades disposed confronting with each other were rotated in the converse directions at the same rotation speed. The stirring rotation speed and the results obtained are shown in Table 5. According to the present invention, excellent stirring condition was observed even at high speed rotation of 5,000 rpm. The leakage of the solution did not occur at all.

TABLE 5

| Characteristics of Tabular Grains | | | | | |
|---|---|---|---|---|---|
| Emulsion | Rotation Speed of Stirring (rpm) | Average Equivalent-Circle Diameter (μm) | Average Thickness (μm) | Variation Coefficient (%) | Remarks |
| 4-A | 1,000 | 1.42 | 0.06 | 28 | Comparison |
| 4-A | 5,000 | 1.51 | 0.06 | 25 | " |
| 4-B | 1,000 | 1.43 | 0.06 | 25 | Invention |
| 4-B | 5,000 | 1.54 | 0.06 | 21 | " |

As is apparent from the results in Table 5, the emulsion of the present invention is small in variation coefficient and the tabular grain size distribution is monodispersion.

EXAMPLE 6

Emulsion 1-A prepared at 3,000 rpm (Comparison) and Emulsion 1-B prepared at 6,000 rpm (Invention) in Example 1 were subjected to chemical sensitization with stirring while maintaining the temperature at 56° C. In the first place, $1\times10^{-4}$ mol (per mol of silver halide) of thiosulfonic acid compound-1 and then 1.0 mol % (based on the entire silver amount) of AgBr having an average grain diameter of 0.10 μm were added, and after 5 minutes, a solution containing 1 wt % of KI was added in an amount of $1\times10^{-3}$ mol per mol of silver halide, further after 3 minutes, thiourea dioxide was added in an amount of $1\times10^{-6}$ mol per mol of silver, the reaction solution was allowed to stand for 22 minutes and reduction sensitization was conducted. Subsequently, 4-hydroxy-6-methyl-1,3,3a,7-tetraazaindene in an amount of $3\times10^{-4}$ mol per mol of silver, and Sensitizing Dyes-1, -2 and -3 were added. Further, calcium chloride was added in an amount of $1\times10^{-2}$ mol/mol-Ag. Furthermore, chloroauric acid in an amount of $1\times10^{-5}$ mol/mol-Ag and potassium thiocyanate in an amount of $3.0\times10^{-3}$ mol/mol-Ag were added, followed by the addition of sodium thiosulfate ($6\times10^{-6}$ mol/mol Ag) and selenium compound-1 ($4\times10^{-6}$ mol/mol Ag). After another 3 minutes, nucleic acid (0.5 g/mol Ag) was added. After 40 minutes, water-soluble mercapto compound-1 was added and the temperature was lowered to 35° C.

Thus, the preparation of emulsion (chemical ripening) was completed.

Thiosulfonic Acid Compound-1

$C_2H_5SO_2SNa$

Sensitizing Dye-1

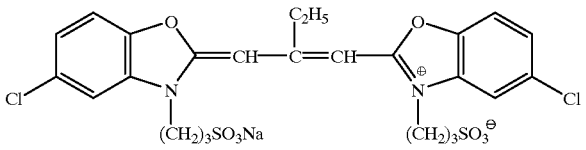

$1\times10^{-3}$ mol/mol-Ag

Sensitizing Dye-2

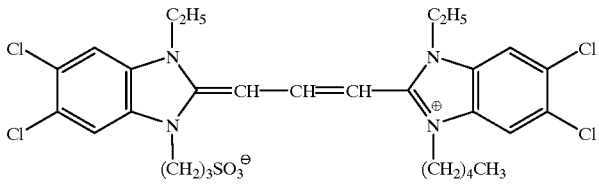

$1\times10^{-5}$ mol/mol-Ag

Sensitizing Dye-3

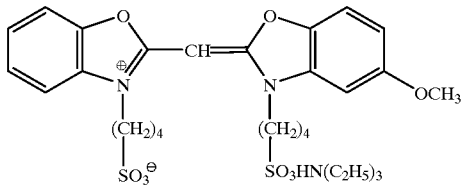

$3\times10^{-4}$ mol/mol-Ag

Selenium Compound-1

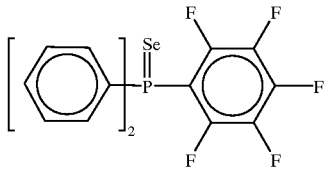

-continued

Water-Soluble Mercapto Compound-1

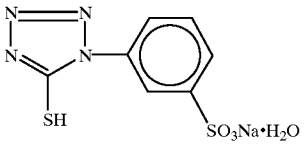

Preparation of Emulsion Laver Coating Solution

The following compounds per mol of silver halide were added to the above emulsion chemically sensitized to prepare an emulsion coating solution.

| | |
|---|---|
| Gelatin (including the gelatin in the emulsion) | 50.0 g |
| Dextran (average molecular weight: 39,000) | 10.0 g |
| Sodium Polyacrylate (average molecular weight: 400,000) | 5.1 g |
| Sodium Polystyrenesulfonate (average molecular weight: 600,000) | 1.2 g |
| Potassium Iodide | 78 mg |
| Hardening Agent, 1,2-Bis(vinylsulfonyl-acetamido)ethane (addition amount was adjusted so that the swelling factor reached 90%) | |
| Compound A-1 | 42.1 mg |
| Compound A-2 | 10.3 g |
| Compound A-3 | 0.11 g |
| Compound A-4 | 8.5 mg |
| Compound A-5 | 0.43 g |
| Compound A-6 | 0.04 g |
| Compound A-7 | 70 g |

Compound A-1

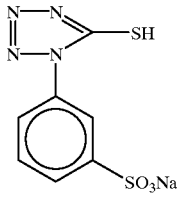

Compound A-2

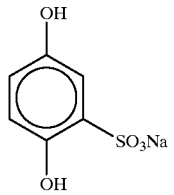

Compound A-3

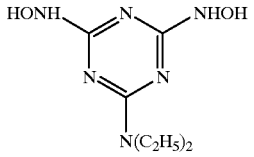

-continued

Compound A-4

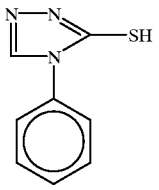

Compound A-5

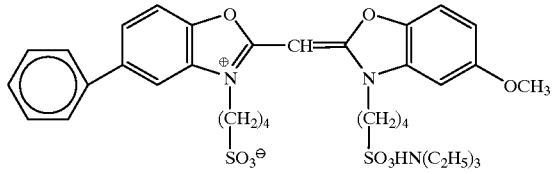

Compound A-6

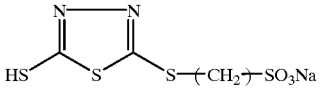

Compound A-7

| | |
|---|---|
| Core/Shell Latex | |
| Core/Shell = 50/50 (wt %) | |
| Core: Styrene/Butadiene Copolymer (37/63 wt %) | |
| Shell: Styrene/2-Acetoacetoxyethyl Methacrylate (84/16 wt %) | |
| Average Diameter: About 0.1 μm | |
| Dye Emulsion a (as dye solid content) | 0.50 g |

Preparation of Dye Emulsion a

Sixty (60) g of Dye-1, 62.8 g of 2,4-diamylphenol, 62.8 g of dicyclohexyl phthalate, and 333 g of ethyl acetate were dissolved at 60° C. Then, 65 ml of a 5 wt % aqueous solution of sodium dodecylbenzenesulfonate, 94 g of gelatin and 581 ml of water were added to the solution, and emulsification-dispersed using a dissolver over 30 minutes at 60° C. Then, 2 g of methyl p-hydroxybenzoate and 6 liters of water were added and the temperature was lowered to 40° C. Subsequently, the emulsion was concentrated until the total weight reached 2 kg using ultrafiltration lab module "ACP1050" manufactured by Asahi Chemical Industry Co., Ltd., and 1 g of methyl p-hydroxybenzoate was added thereto to obtain Dye Emulsion a.

Dye-1

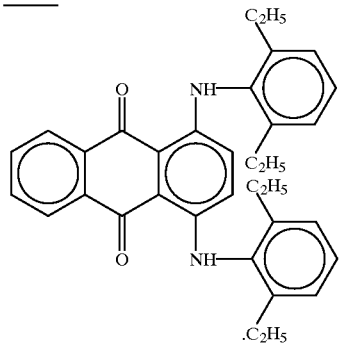

| | |
|---|---|
| .Dye Emulsion m (as dye solid content) | 30 mg |

Preparation of Dye Emulsion m

After 10 g of Dye-2 was weighed out and dissolved in a solvent comprising 10 ml of tricresyl phosphate and 20 ml of ethyl acetate, the solution was emulsification-dispersed in 100 ml of a 15 wt % gelatin aqueous solution containing 750 mg of Anionic Surfactant-1 to thereby obtain Dye Emulsion m.

Dye-2

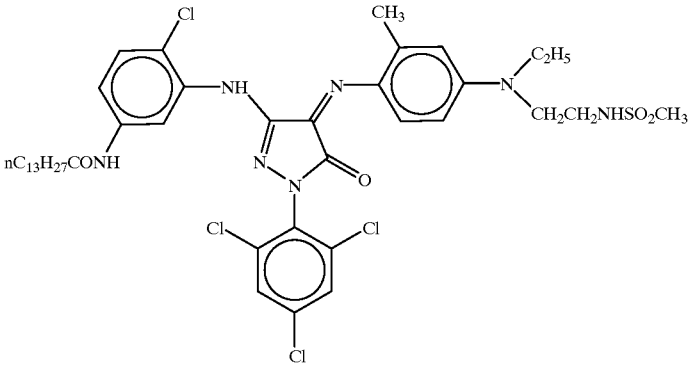

Anionic Surfactant-1

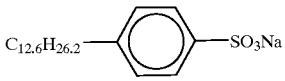

pH was adjusted to 6.1 with NaOH.

Preparation of Dye Laver Coating Solution

Coating solution was prepared so that the coating weight of each composition is indicated below.

| | |
|---|---|
| Gelatin | 0.25 g/m$^2$ |
| Compound A-8 | 1.4 mg/m$^2$ |
| Compound A-8 | |

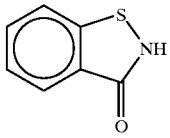

| | |
|---|---|
| Sodium Polystyrenesulfonate (average molecular weight: 600,000) | 5.9 mg/m$^2$ |
| Dye Dispersion i (as dye solid content) | 20 mg/m$^2$ |

Preparation of Dye Dispersion i

Dye-3 was weighed out such that the weight as a dry solid content became 6.3 g, which was dealt with as a wet cake so as not to be dried. Dispersant Aid V, which was handled as a 25 wt % aqueous solution, was added to the dye such that the addition weight as a dry solid content became 30 wt % based on the dye solid content. Water was added to make the entire weight 63.3 g, well mixed to thereby obtain slurry. 100 ml of zirconia beads having an average diameter of 0.5 mm were filled in a vessel with the slurry and the content was dispersed for 6 hours using a disperser (1/16G sand grinder mill manufactured by Imex Co.). Water was added to dilute the dispersion to dye concentration of 8 wt %.

Thus, a dye dispersion solution was obtained.

The obtained dispersion was mixed with photographic gelatin such that the dye solid content was 5 wt % and the photographic gelatin was equal wt % with the dye solid content. Distilled water was added to make Additive D as a preservative having the concentration of 2,000 ppm based on gelatin and refrigerated in a jelly state.

Non-elution type Dye Dispersion i as a solid fine grain dispersion dye having light absorption maximum at 915 nm was thus obtained.

The average grain diameter of solid fine grain of Dye Dispersion i was 0.4 $\mu$m.

Dye-3

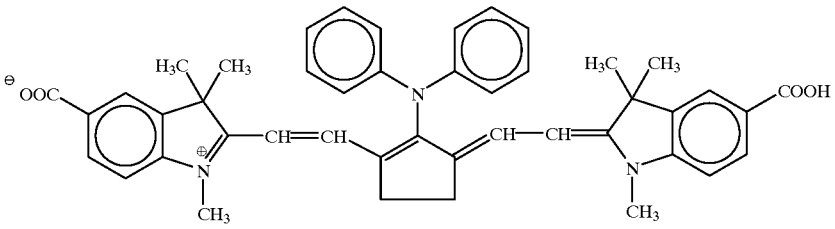

Dispersant Aid V

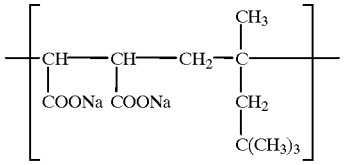

(average molecular weight: 14,300)

Additive D

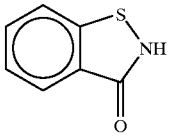

Preparation of Coating Solution for Surface Protective Layer

A surface protective layer was prepared so that the coating weight of each composition is indicated below.

| | |
|---|---|
| Gelatin | 0.780 g/m$^2$ |
| Sodium Polyacrylate (average molecular weight: 400,000) | 0.025 g/m$^2$ |
| Sodium Polystyrenesulfonate (average molecular weight: 600,000) | 0.0012 g/m$^2$ |
| Matting Agent-1 (average particle diameter: 3.7 $\mu$m) | 0.072 g/m$^2$ |
| Matting Agent-2 (average particle diameter: 0.7 $\mu$m) | 0.010 g/m$^2$ |

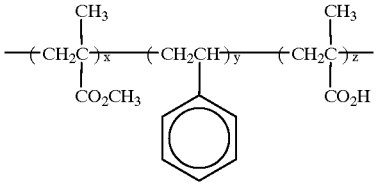

Matting Agent-1: x/y/z = 76.3/17.5/6.2
Matting Agent-1: x/y/z = 70/15/15

| | |
|---|---|
| Compound A-9 | 0.018 g/m$^2$ |
| Compound A-10 | 0.037 g/m$^2$ |
| Compound A-11 | 0.0068 g/m$^2$ |
| Compound A-12 | 0.0032 g/m$^2$ |
| Compound A-13 | 0.0012 g/m$^2$ |
| Compound A-14 | 0.0022 g/m$^2$ |
| Compound A-15 | 0.030 g/m$^2$ |
| Proxel (manufactured by ICI Co.) | 0.0010 g/m$^2$ |

-continued (pH was adjusted to 6.8 with NaOH)

Compound A-9

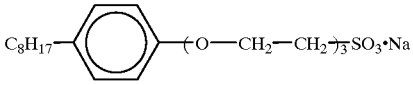

Compound A-10

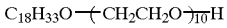

Compound A-11

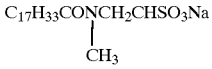

Compound A-12

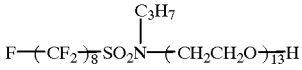

Compound A-13

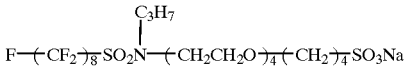

Compound A-14

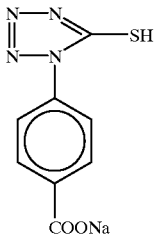

-continued

Compound A-15

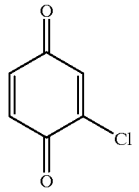

Preparation of Support

(1) Preparation of Dye Dispersion B for Undercoat Layer

The following Dye-4 was treated by a ball mill according to the method disclosed in JP-A-63-197943.

Dye-4

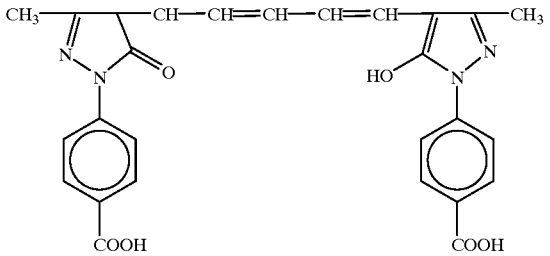

Four hundred and thirty four (434) ml of water and 791 ml of a 6.7% aqueous solution of Triton X-200 (registered trademark) surfactant (TX-200 (registered trademark)) were put in a ball mill having a capacity of 2 liters. 20 g of Dye-4 was added to this solution. 400 ml of zirconium oxide ($ZrO_2$) beads (diameter: 2 mm) was added thereto and the content was pulverized over 4 days. Then, 160 g of 12.5% gelatin was added. After defoaming, $ZrO_2$ beads were removed by filtration. As a result of observing the obtained dye dispersion, it was confirmed that the grain sizes of the pulverized dye accounted for a wide range of from 0.05 to 1.15 μm and the average grain size was 0.37 μm. The dye grains of the grain size of 0.9 μm or more were removed by centrifugal operation. Thus, Dye Dispersion B was obtained.

(2) Preparation of Support

A biaxially stretched polyethylene terephthalate film having a thickness of 175 μm was corona discharged, and the first undercoat solution having the following composition was coated by a wire bar coater such that the coating amount reached 4.9 ml/m$^2$, and then dried at 185° C. for 1 minute. Then, the first undercoat layer was also coated on the opposite side similarly. The polyethylene terephthalate used contained 0.04 wt % of Dye-1.

First Undercoat Solution

| | |
|---|---|
| Solution of Butadiene-Styrene Copolymer Latex (solid content: 40%, weight ratio of butadiene/styrene = 31/69) | 158 ml |
| A 4 wt % Solution of Sodium 2,4-Dichloro-6-hydroxy-s-triazine | 41 ml |
| Distilled Water | 801 ml |

In a latex solution, 0.4 wt %, based on the solid content of the latex, of Compound A-16 was contained as an emulsification dispersant.

Compound A-16

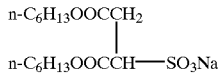

(3) Coating of Undercoat Layer

On the first undercoat layers of both sides of the above support was coated the second undercoat layer having the following composition so as to reach the coating weight indicated below, one by one using a wire bar coater, and then dried at 155° C.

| | |
|---|---|
| Gelatin | 80 mg/m$^2$ |
| Dye Dispersion B (as dye solid content) | 50 mg/m$^2$ |
| Compound A-17 | 1.8 mg/m$^2$ |
| Compound A-18 | 0.27 mg/m$^2$ |
| Matting Agent (polymethyl methacrylate having an average particle size of 2.5 μm) | 2.5 mg/m$^2$ |

Compound A-17

$C_{12}H_{25}O(CH_2CH_2O)_{10}H$

Compound A-18

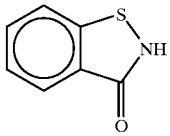

Preparation of Photographic Material

On both sides of the above prepared support, the aforementioned dye layer, emulsion layer and the surface protective layer were coated in combination with a double extrusion method and dried. The coating weight of silver per one side was 1.4 g/m$^2$ and the total coating weight of gelatin per one side was 1.8 g/m$^2$.

Measurement of Swelling Factor

The photographic material to be measured is aged under the conditions of 40° C., 60% RH for 7 days. Then, the material is immersed in distilled water of 21° C. for 3 minutes, and freeze fixed by liquid nitrogen as it is. The material is cross-sectionally cut vertically to the surface of the material with a microtome, followed by freeze drying at −90° C. The material undergone the above processes is observed with a scanning electron microscope and swollen film thickness Tw is found. On the other hand, dry film thickness Td is also found by observation of the cross section of the film with a scanning electron microscope. Swelling factor (%) is the value obtained by dividing the difference between Tw and Td by Td and multiplying 100.

$$\text{Swelling factor (\%)}=[(Tw-Td)/Td]\times 100$$

In this photographic material, Tw=3.5 μm, Tw=6.65 μm, and the swelling factor was 90% as described above.

Preparation of Developing Solution

The developing solution having the following composition using sodium erysorbic acid as a developing agent was prepared.

| | |
|---|---|
| Diethylenetriaminepentaacetic Acid | 8.0 g |
| Sodium Sulfite | 20.0 g |
| Sodium Carbonate Monohydrate | 52.0 g |
| Potassium Carbonate | 55.0 g |
| Sodium Erysorbic Acid | 60.0 g |
| 4-Hydroxymethyl-4-methyl-1-phenyl-3-pyrazolidone | 13.2 g |
| 3,3'-Diphenyl-3,3'-dipropionic Acid | 1.44 g |
| Diethylene Glycol | 50.0 g |
| 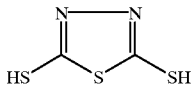 | 0.15 g |
| 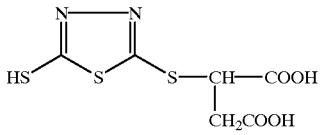 | 0.3 g |
| Water to make | 2 liters |
| pH (adjusted with sodium hydroxide) | 10.1 |

Preparation of Developing Replenisher

The above developing solution was used as it was as a developing replenisher.

Preparation of Developing Mother Solution

Two liters of the above developing solution was taken out and 55 ml of the following starting solution was added per liter of the developing solution to make a developing mother solution having pH of 9.5.

Preparation of Starting Solution

| | |
|---|---|
| Potassium Bromide | 11.1 g |
| Acetic Acid | 10.8 g |
| Water to make | 55 ml |

Preparation of Concentrated Fixing Solution

A concentrated fixing solution having the following composition was prepared.

| | |
|---|---|
| Water | 0.5 liter |
| Ethylenediaminetetraacetic Acid Dihydrate | 0.05 g |
| Sodium Thiosulfate | 200 g |
| Sodium Bisulfite | 98.0 g |
| Sodium Hydroxide | 2.9 g |
| pH (adjusted with NaOH) | 5.2 |
| Water to make | 1 liter |

Preparation of Fixing Replenisher

The above concentrated fixing solution was diluted to 2 times with the waste solution of the first washing water and used as a fixing replenisher.

Preparation of Fixing Mother Solution

The above concentrated fixing solution was diluted to 4 times with water. pH was 5.4.

Washing Water Replenisher

| | |
|---|---|
| Glutaraldehyde | 0.3 g |
| Diethylenetriaminepentaacetic Acid | 0.5 g |

The above compositions were diluted with distilled water and adjusted with NaOH to pH of 4.5 to thereby obtain one liter of a finished solution.

Processing Step of Photographic Material

The washing tank of a processor CEPROS-S (a product modified by Fuji Photo Film Co., Ltd.) was modified to two-stage countercurrent system and the second washing tank was replenished with water. Further, each open factor of the developing tank and the fixing tank was modified to 0.02. The capacities of the washing tanks were each 6 liters. Drying was conducted according to a heat roller system (the surface temperature of the roller: 85° C.).

Processing was carried out using the above developing mother solution, fixing mother solution and washing water replenisher with replenishing the developing replenisher, fixing replenisher and washing water replenisher each in replenishing rate of 65 ml per $m^2$ of the photographic material.

| Step | Processing Temperature (° C.) | Processing Time (sec) |
|---|---|---|
| Development | 35 | 8 |
| Fixing | 35 | 7 |
| Washing (1) | 30 | 5 |
| Washing (2) | 25 | 5 |
| Drying | | 3 |
| Total | | 28 |

Evaluation of Photographic Capabilities

The photographic material was exposed from both sides for 0.05 sec. using X-ray ortho-screen HGM (a product of Fuji Photo Film Co., Ltd.) and processed.

As a result, the sample prepared using Emulsion 1-B (Invention) which was produced by stirring of 6,000 rpm showed higher gradation, sensitivity higher by 15% and fog lower by 0.02 than those of the sample prepared using Emulsion 1-A (Comparison) which was produced by stirring of 3,000 rpm.

EFFECT OF THE INVENTION

As described above, the problem has been completely solved by constructing the stirring blades of the structure having no rotary shaft protruding the tank wall, thereby a sealing liquid used for liquid seal is completely prevented from mixing in the tank and contaminating the solution as an impurity. Further, by rotating opposite pairs of stirring blades in converse directions to thereby prevent the generation of a vacancy at the central part of the stirring tank by the inhibition of the generation of the flow in the shaft direction. Further, mixing efficiency can be easily improved by high speed rotation of stirring blades to thereby increase emulsion production efficiency. Further, according to the present invention, the formation of thin and homogeneous tabular silver halide grains in a reaction vessel can be actualized by the formation of extremely fine grains of a uniform size in a mixing vessel.

While the invention has been described in detail and with reference to specific examples thereof, it will be apparent to one skilled in the art that various changes and modifications can be made therein without departing from the spirit and scope thereof.

What is claimed is:

1. A method for producing a silver halide emulsion which comprises:

supplying a water-soluble silver salt aqueous solution and a water-soluble halide aqueous solution from solution-feeding ports provided in a stirring tank which is closed except for the presence of solution-feeding ports and a solution-discharging port;

controlling a stirring condition of the mixture of aqueous solutions supplied by rotation-driving at least one pair of stirring blades having no rotary shaft protruding through a wall of the stirring tank, which are deposited in said stirring tank;

discharging silver halide fine grains which are formed with the completion of a residence time for the stirring process from a solution-discharging port provided in a stirring tank which is closed except for the presence of solution-feeding ports and a solution-discharging port; and supplying said silver halide fine grains to a reaction vessel where nucleation and/or grain growth of silver halide grains are conducted;

wherein each of said stirring blades has a magnetic coupling relationship with an outer magnet disposed outside the tank wall adjacent to each stirring blade and each stirring blade having no rotary shaft protruding through a tank wall is rotation-driven by a motor connected to said outer magnet;

wherein a double side bipolar magnet comprising an N pole face and an S pole face disposed so as to be parallel to a central axis of rotation and superposed interposing said central axis of rotation is used in one of said stirring blades and said outer magnet coupled by magnetic coupling, and a bilateral bipolar magnet comprising an N pole face and an S pole face standing abreast at symmetrical positions to said central axis of rotation on a plane orthogonal to said central axis of rotation is used in another.

2. A method for producing a silver halide emulsion which comprises:

supplying a water-soluble silver salt aqueous solution and a water-soluble halide aqueous solution from solution-feeding ports provided in a stirring tank which is closed except for the presence of solution-feeding ports and a solution-discharging port disposing at least two pairs of stirring blades having no rotary shaft protruding through a wall of the stirring tank at opposed positions in the tank with a distance between, rotation-driving these stirring blades in converse directions, and controlling a stirring condition of the mixture of aqueous solutions supplied;

discharging silver halide fine grains which are formed with the completion of a residence time for the stirring process from a solution-discharging port provided in a stirring tank which is closed except for the presence of solution-feeding ports and a solution-discharging port; and supplying said silver halide fine grains to a reaction vessel where nucleation and/or grain growth of silver halide grains are conducted;

wherein each of said stirring blades has a magnetic coupling relationship with an outer magnet disposed outside the tank wall adjacent to each stirring blade and each stirring blade having no rotary shaft protruding through a tank wall is rotation-driven by a motor connected to said outer magnet;

wherein a double side bipolar magnet comprising an N pole face and an S pole face disposed so as to be parallel to a central axis of rotation and superposed interposing said central axis of rotation is used in one of said stirring blades and said outer magnet coupled by magnetic coupling, and a bilateral bipolar magnet comprising an N pole face and an S pole face standing abreast at symmetrical positions to said central axis of rotation on a plane orthogonal to said central axis of rotation is used in another.

* * * * *